US006304024B1

(12) United States Patent
Uda et al.

(10) Patent No.: US 6,304,024 B1
(45) Date of Patent: Oct. 16, 2001

(54) IMPREGNATED-TYPE CATHODE SUBSTRATE WITH LARGE PARTICLE DIAMETER LOW POROSITY REGION AND SMALL PARTICLE DIAMETER HIGH POROSITY REGION

(75) Inventors: Eiichirou Uda, Tokyo; Toshiharu Higuchi, Yokohama; Osamu Nakamura, Tokyo; Kiyomi Koyama, Yokohama; Sadao Matsumoto, Sagamihara; Yoshiaki Ouchi; Kazuo Kobayashi, both of Yokohama; Takashi Sudo, Chigasaki; Katsuhisa Homma, Yokosuka, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/466,472

(22) Filed: Dec. 17, 1999

Related U.S. Application Data

(62) Division of application No. 08/981,187, filed on Dec. 9, 1997, now Pat. No. 6,034,469.

(30) Foreign Application Priority Data

Jun. 9, 1995 (JP) ..... 7-143127

(51) Int. Cl.[7] ..... H01J 1/28; H01J 1/14

(52) U.S. Cl. ..... 313/310; 313/346 R; 313/446; 331/6; 330/34; 315/344

(58) Field of Search ..... 313/346 R, 346 DC, 313/446; 331/6; 330/34; 315/344, 447–455, 456, 458

(56) References Cited

U.S. PATENT DOCUMENTS

| | | | |
|---|---|---|---|
| 4,369,392 | 1/1983 | Hotta et al. . | |
| 4,626,470 | 12/1986 | Yamamoto et al. . | |
| 4,737,679 | 4/1988 | Yamamoto et al. . | |
| 4,783,613 | 11/1988 | Yamamoto et al. . | |
| 4,980,603 | 12/1990 | Kimura et al. . | |
| 5,122,707 | 6/1992 | Nakanishi et al. . | |
| 5,418,070 | 5/1995 | Green . | |
| 5,545,945 * | 8/1996 | Branovich et al. | 313/346 R |

FOREIGN PATENT DOCUMENTS

| | | |
|---|---|---|
| 2 683 090 | 4/1993 | (FR) . |
| 32-1630 | 3/1957 | (JP) . |
| 56-52835 | 5/1981 | (JP) . |
| 58-133739 | 8/1983 | (JP) . |
| 58-15431 | 9/1983 | (JP) . |
| 58-177484 | 10/1983 | (JP) . |
| 59-79934 | 5/1984 | (JP) . |
| 59-203343 | 11/1984 | (JP) . |
| 61-91821 | 5/1986 | (JP) . |
| 64-21843 | 1/1989 | (JP) . |
| 1-161638 | 6/1989 | (JP) . |

(List continued on next page.)

OTHER PUBLICATIONS

Patent Abstracts of Japan, No. 59–203343, Nov. 17, 1984, Appln. No. 58–077432, May 1983, Yamamoto Yoshihiko, "Impregnated Cathode".

*Primary Examiner*—Michael H. Day
*Assistant Examiner*—Matthew J. Gerike
(74) *Attorney, Agent, or Firm*—Pillsbury Winthrop LLP

(57) ABSTRACT

There is provided an impregnated-type cathode substrate comprising a large particle diameter low porosity region and a small particle diameter high porosity region which is provided in a side of an electron emission surface of the large particle diameter low porosity region and has an average particle diameter smaller than an average particle diameter of the large particle diameter low pore region and a porosity higher than a porosity of the large particle diameter low porosity region, the impregnated-type cathode being impregnated with an electron emission substance.

10 Claims, 9 Drawing Sheets

FOREIGN PATENT DOCUMENTS

| | | |
|---|---|---|
| 3-25824 | 2/1991 | (JP) . |
| 3-105827 | 5/1991 | (JP) . |
| 3-167732 | 7/1991 | (JP) . |
| 3-173034 | 7/1991 | (JP) . |
| 4-286827 | 10/1992 | (JP) . |
| 5-82016 | 4/1993 | (JP) . |
| 5-258659 | 10/1993 | (JP) . |
| 5-266786 | 10/1993 | (JP) . |
| 5-347127 | 12/1993 | (JP) . |

* cited by examiner

IMPREGNATED-TYPE CATHODE SUBSTRATE WITH LARGE PARTICLE DIAMETER LOW POROSITY REGION AND SMALL PARTICLE DIAMETER HIGH POROSITY REGION

This is a division of Application Ser. No. 08/981,187, filed Dec. 9, 1997, now U.S. Pat. No. 6,034,469.

TECHNICAL FIELD

The present invention relates to an electron tube such as a color picture tube, a klystron tube, a traveling wave tube, a gyrotron tube.

BACKGROUND ART

In recent years, a micro-wave electron tube such as a klystron or the like have had a tendency to exhibit a high output. Particularly, those tubes which are used in a plasma apparatus for nuclear fusion or a particle accelerator exhibit an output of a megawatt or more. A much higher output is required for those tubes. Meanwhile, there have been demands for developments in a color picture tube improved in resolution by increasing scanning lines and a super high frequency responsive picture tube, and hence, improvements in brightness have been required. Improvements in brightness have also been required for a projection tube. To respond to these requirements and demands, the emission current density of a current from a cathode must be greatly increased in comparison with a conventional apparatus.

Several conventional electronic tubes such as a color picture tube used in a color picture receiver require a high voltage supplied to a convergence electrode, a focus electrode or the like, in addition to an anode voltage. In this case, a problem issues in the aspect of a withstand voltage if a high voltage is supplied from a stem portion of the color picture tube. Therefore, a method is adopted in which a resister for a divisional voltage together with an electron gun are incorporated as a electron-gun built-in resister into the color picture tube and in which an anode voltage is divided to supply high voltages to electrodes, respectively.

Starting from studies made in 1939, developments have been made to use this tube as an amplifier tube, an oscillation tube, or the like which can widely response to an UHF band to a milli wave range. In 1960s, further developments have been started to use a klystron tube for a satellite communication earth station. In 1970s, studies have been promoted in view of high efficiency operation of a klystron tube, and products with an efficiency of 50% or more have been put into practical use including UHF-TV broadcasting. Recently, a klystron tube of a super high power has been developed which attains an efficiency of 50 to 70%, a continuous wave output of 1 MW, and a pulse output of 150 MW, and has been used in an accelerator of a super large scale, a plasma heating apparatus for nuclear fusion studies. A klystron tube can generate a high power at a high efficiency, and is therefore used widely in the field of high power tubes.

A traveling wave tube was invented in 1943 and was completed thereafter. There are various types of traveling wave tubes, such as a spiral type, a cavity coupling type, a cross finger type, a ladder type, and the likes. A traveling wave tube of a spiral type has been widely used as a transmitting tube to be mounted on an air-plane, an artificial satellite or the like. A cavity connection type traveling wave tube has been developed for the purpose of compensating for a withstanding power capacitance of a spiral type, and has been put into practice mainly as a transmitting tube for a satellite communication earth station. Although a traveling wave tube normally attains an efficiency of about several to 20%, a traveling wave tube which attains an efficiency of 50% has been developed for a satellite when electrical potential depression-type corrector is provided with the traveling wave tube.

Meanwhile, as well-known, a gyrotron tube is an electron tube based on an operation principle of a cyclone maser effect, and is used as a high frequency high power source which generates a high power milli wave of several tens to several hundreds GHz.

An impregnated-type cathode ensures a higher emission current density than an oxide cathode, and has therefore been used as an electron tube for a cathode ray tube, a traveling wave tube, a klystron tube, a gyrotron tube, or the like. Use of an impregnated-type cathode has been limited to particular applications such as an HD-TV tube, an ED-TV tube, and the likes, in the field of color picture tubes. However,.demands for a large-size CRT and the likes have increased in recent years, and the use filed of an impregnated-type cathode has been rapidly expanded.

For example, in case of an impregnated-type cathode assembly used in klystron tubes and color picture tubes, the cathode substrate is made of porous tungsten (W) of a porosity 15 to 20%, and the porous portion of this cathode substrate is impregnated with electron emission substances such as barium oxide (BaO), calcium oxide (CaO), aluminum oxide ($Al_2O_3$), and the likes. Further, an iridium (Ir) thin film layer is provided on the electron emission surface of the cathode substrate by a thin film formation means like a sputtering method, thereby using an impregnated-type cathode assembly coated with iridium.

In this cathode assembly, for example, barium (Ba) and oxygen ($O_2$) impregnated in the cathode assembly is diffused by an aging step after the cathode assembly is mounted in the electron tube, so that dipole layer is formed on the electron emission surface of the cathode assembly surface. As a result, a high emission current is enabled.

Although the aging time in an aging step is variously arranged in accordance with an applied voltage during use of an electron tube as a target, an dipole layer can be formed in an aging time of about 50 hours in case of an electron tube used in low voltage operation, for example, with an applied voltage of about 10 kV.

On the contrary, in case of an electron tube used in high voltage operation, e.g., a super high power klystron tube used with an applied voltage of 70 kV, a current of a sufficient current density can be picked up by aging of a relatively short time period of several tens hours where a current picked up has a pulse width of 5 $\mu$s and is repeated for 500 times for every one second. However, if a current thus picked up is a direct current, aging requires 500 hours or more to pick up a current of an equal current density.

In case of an electron tube such as a super high power klystron tube used in high voltage operation, a large amount of gas emitted from a collector is collided with electrons to be ionized at the same time when an dipole layer is formed by means of aging. Further, these ions collide with an electron emission surface due to a high voltage, thereby breaking the dipole layer. In this state, the ionized gas has a high energy. As the amount of gas which collides with the electron emission surface increases, the dipole layer of the electron emission surface is broken seriously. Therefore, an electron tube used in high voltage operation requires aging of a long time.

In addition, an impregnated-type cathode assembly for a cathode ray tube is formed to have a compact structure for the purpose of energy saving. Therefore, an impregnated-type cathode assembly for a cathode ray tube has a limited thickness and a limited diameter which make it difficult to impregnate a sufficient amount of electron emission substance. Generally, the characteristics of the life-time of an impregnated-type cathode are dependent on the amount of evaporation of barium as a main component of electron emission substance. As barium is consumed by evaporation, the monolayer covering late decreases. Electron emission ability decreases in accordance with an increase in the work function. As a result of this, the long life-time characteristic cannot be achieved. This is a large practical problem. From this stand of view, an impregnated-type cathode assembly is desired which can be operated at a low temperature.

In recent years, attentions have been paid to a scandium-based (or Sc-based) impregnated-type cathode assembly as such a cathode assembly for a cathode ray tube.

The scandium-based impregnated-type cathode assembly described above has an excellent pulse emission characteristic at a low duty, in comparison with an impregnated-type cathode assembly coated with metal, and is expected to be capable of operating at a low temperature.

However, in this scandium-based impregnated-type cathode assembly which can be operated at a low temperature, recovery of lost Sc is slow and the operation ability at a low temperature is lowered if the cathode once receives an ion impact under a condition of a high frequency. Thus, this assembly is not sufficiently practicable.

For example, in case of a type in which a scandium compound is covered over the surface of the cathode substrate, the surface state changes during steps of manufacturing a cathode. Operation over a long time leads to dissipation of scandium and to deterioration in the electron emission characteristic. In addition, the surface of the substrate is locally broken due to ion impacts, and the work function of broken portions is raised so that the distribution of electron emission becomes non-uniform.

As a result of Auger surface analysis in a scandium-based impregnated-type cathode, it has been determined that scandium on the surface is lost upon an ion impact and recovery-of an excellent density of electron emission requires a long time, in case of a scandium-based impregnated-type cathode.

The followings are examples of a conventional cathode substrate.

Japanese Patent Application KOKAI Publication No. 56-52835 and Japanese Patent Application KOKAI Publication No. 58-133739 disclose a cathode substrate in which a cover layer having a porosity of 17 to 30% is provided on a porous substrate, and this porosity of the cover layer is lower than that of the porous substrate. However, in this kind of cathode substrate, the porosity of the cover layer is arranged to be low, and therefore, evaporation of an electron emission substance is restricted to be low, so that the life-time of the cathode can be elongated. However, under operating condition that ion impacts are strong as in an electron tube which operates at a high current density, recovery of the structure of the cathode substrate surface is late, so that excellent results cannot be obtained. Japanese Patent Application KOKAI Publication 58-177484 discloses a cathode substrate containing scandium, which cannot attain sufficient recovery of scandium after an ion impact. Therefore, this cathode substrate achieves only an insufficient low-temperature operation ability. Japanese Patent Application KOKAI Publication 59-79934 discloses a cathode substrate in which a layer containing high melting point metal and scandium is formed on a high melting point metal layer. In this cathode substrate, recovery of scandium after an ion impact is not sufficient, and therefore, a sufficient operation ability at a low temperature cannot be attained.

Japanese Patent Application KOKAI Publication 59-203343 discloses a cathode substrate in which a uniform layer containing fine tungsten of 0.1 to 2 $\mu$m, scandium oxide and electron emission substances is formed on a porous base made of tungsten. This cathode substrate contains scandium, and therefore, can be operated at a low temperature. However, under operating condition that ion impacts are strong, recovery of the structure of the cathode substrate surface is late, so that excellent results cannot be obtained. Japanese Patent Application KOKAI Publication 61-91821 discloses a cathode substrate in which a cover layer made of tungsten and scandium oxide is provided on a porous substrate. This cathode substrate contains scandium, and therefore, can be operated at a low temperature. However, under operating condition that ion impacts are strong, recovery of the structure of the cathode substrate surface is late, so that excellent results cannot be obtained. Japanese Patent Application KOKAI Publication 64-21843 discloses a cathode substrate in which a first formed body having a large average particle diameter of, for example, 20 to 15 $\mu$m is provided, and a top head whose average particle diameter is smaller than that of the first formed body is provided on the first formed body. In this cathode substrate, evaporation of an electron emission substance is restricted to be low, and therefore, the life-time of the cathode can be elongated. However, under operating condition that ion impacts are strong, recovery of the structure of the cathode substrate surface is late, so that excellent results cannot be obtained.

Further, Japanese Patent Application KOKAI Publication 1-161638 discloses a cathode substrate in which a layer of scandium compound or scandium alloy is provided on a porous substrate made of high melting point metal. Japanese Patent Application KOKAI Publication No. 3-105827 and Japanese Patent Application KOKAI Publication No. 3-25824 disclose a cathode substrate in which a layer of a layered structure or of a mixture substance is formed on a porous substrate. The layered structure consists of a mixture layer of tungsten and scandium oxide, and a layer of a scandium supplier, e.g., Sc combined with Re, Ni, Os, Ru, Pt, W, Ta, Mo, or the like. The mixture substance is made of these materials. Japanese Patent Application KOKAI Publication No. 3-173034 discloses a cathode substrate in which a layer containing barium and scandium is included as an upper layer of a high melting point metal porous substrate. Japanese Patent Application KOKAI Publication No. 5-266786 discloses a cathode substrate in which, for example, a layered structure containing high melting point metal such as a tungsten layer, a scandium layer, a rhenium layer and the like is formed on a porous substrate made of high melting point metal. However, the cathode substrates described above cannot ensure sufficient recovery of scandium after an ion impact, the low-temperature operation ability is insufficient. Thus, a sufficient ion-impact resistance cannot be attained.

DISCLOSURE OF INVENTION

As has been explained above, a conventional impregnated-type cathode assembly cannot attain a sufficient ion-impact resistance under condition of a high voltage and a high frequency. Therefore, deterioration in the electron emission characteristic due to an ion impact cannot be sufficiently prevented, and hinders improvements in outputs of an electron tube and in brightness of a picture tube.

In addition, in a scandium-based impregnated-type cathode assembly which can be operated at a low temperature, there is a drawback that recovery of lost Sc is late and the operation ability at a low temperature is deteriorated if the cathode once receives an ion impact under condition of a high frequency. Thus, this cathode assembly is not sufficiently practicable.

The present invention has been made in view of problems as described above, and has a first object of providing an improved impregnated-type cathode substrate with a high performance and a long life-time, which exhibits a sufficient ion-impact resistance and an excellent electron emission under condition of a high voltage and a high frequency.

The present invention has a second object of obtaining an excellent impregnated-type cathode assembly with use of an improved impregnated-type cathode substrate.

The present invention has a third object of obtaining an excellent electron gun assembly with use of an improved impregnated-type cathode substrate.

The present invention has a fourth object of obtaining an excellent electron tube with use of an improved impregnated-type cathode substrate.

The present invention has a fifth object of providing a preferred method of manufacturing an impregnated substrate according to the present invention.

Firstly, the present invention provides an impregnated-type cathode substrate comprising a large particle diameter low porosity region and a small particle diameter high porosity region which is provided in a side of an electron emission surface of the large particle diameter low porosity region and has an average particle diameter smaller than an average particle diameter of the large particle diameter low porosity region and a porosity higher than a porosity of the large particle diameter low porosity region, said impregnated-type cathode being impregnated with an electron emission substance.

Secondly, the present invention provides a method of manufacturing an impregnated-type cathode substrate according to the first present invention, characterized by comprising:

a step of forming a porous sintered body to form a large particle diameter low porosity region;

a step of obtaining a porous cathode pellet by forming a small particle diameter high porosity region in an electron emission surface side of the porous sintered body, said small particle diameter high porosity region having an average particle diameter smaller than that of the large particle diameter low porosity region and a porosity higher than the porosity of the large particle diameter low porosity region;

a step of cutting or punching the-porous pellet, thereby to form a porous cathode substrate; and a step of impregnating the porous cathode substrate with an electron emission substance.

Thirdly, the present invention provides a method of manufacturing an impregnated-type cathode substrate according to the first aspect of the invention, characterized by comprising:

a step of forming a porous sintered body to form a large particle diameter low porosity region;

a step of obtaining a porous cathode pellet by forming a small particle diameter high porosity region in an electron emission surface side of the porous sintered body, said small particle diameter high porosity region having an average particle diameter smaller than that of the large particle diameter low porosity region and a porosity higher than that of the large particle diameter low porosity region;

a step of providing a filler selected from a group of metal and synthetic resin having a melting point of 1200° C. or less, in the electron emission surface side of the porous cathode pellet;

a step of heating the porous cathode pellet provided with the filler, at a temperature at which the filler can be melted, such that only the filler is melted;

a step of cutting or punching the porous sintered body into a predetermined size, to form a porous cathode substrate;

a step subjecting the porous cathode substrate to tumbling processing, thereby to remove burrs and contaminations;

a step of removing the filler from the porous cathode substrate subjected to the tumbling processing; and a step of impregnating the porous cathode substrate from which the filler has been removed, with an electron emission substance.

Fourthly, the present invention provides a method of manufacturing an impregnated-type cathode substrate according to the first aspect of the invention, characterized by comprising:

a step of forming a sintered body made of high melting point metal to form a large particle diameter low porosity region;

a step of preparing paste containing high melting point metal powder having an average particle diameter smaller than that of the large particle diameter low porosity region and at least one kind of filler selected from a group of metal and synthetic resin having a melting point of 1200° C. or less;

a step of applying the paste to an electron emission surface side of the porous sintered body made of high melting point metal to form the large particle diameter low porosity region;

a step of heating the porous sintered body made of high melting point metal of the large particle diameter low porosity region applied with the paste, to a temperature at which the filler can be melted, such that a small particle diameter high porosity region having an average particle diameter smaller than that of the large particle diameter low porosity region and a porosity higher than that of the large particle diameter low porosity region is formed, thereby to obtain a porous cathode pellet;

a step of cutting or punching the porous sintered body into a predetermined size, to form a porous cathode substrate;

a step of subjecting the porous cathode substrate to tumbling processing, to remove burrs and contaminations;

a step of removing the filler from the porous cathode substrate subjected to the tumbling processing; and a step of impregnating the porous cathode substrate with an electron emission substance.

Fifthly, the present invention provides an impregnated-type cathode assembly characterized by including an impregnated-type cathode substrate according to the first aspect of the invention.

Sixthly, the present invention provides an electron gun assembly characterized by comprising an electron gun provided with an impregnated-type cathode assembly including an impregnated-type cathode substrate according to the first aspect of the invention.

Seventhly, the present invention provides an electron tube comprising an electron gun assembly using an electron gun provided with an impregnated-type cathode assembly including an impregnated-type cathode substrate according to the first aspect of the invention.

Since the impregnated-type cathode assembly according to the present invention uses an improved cathode substrate, the assembly attains a sufficient ion-impact resistance under condition of a high voltage and a high frequency, thus achieving an excellent electron emission characteristic.

In addition, since a layer made of a particular substance is formed on an electron emission surface of the impregnated-type cathode, the operation ability at a low temperature is much improved.

Further, since an impregnated-type cathode having a surface and pore portions of an excellent condition is obtained by using the manufacturing method according to the present invention, it is possible to provide an impregnated-type cathode assembly which has a sufficient ion-impact resistance and an excellent electron emission characteristic.

Furthermore, by using an impregnated-type cathode assembly according to the present invention, it is possible to obtain an electron gun assembly and an electron tube which can operate-excellently under condition of a high voltage and a high frequency.

BEST MODE OF CARRYING OUT THE INVENTION

Figure 1:
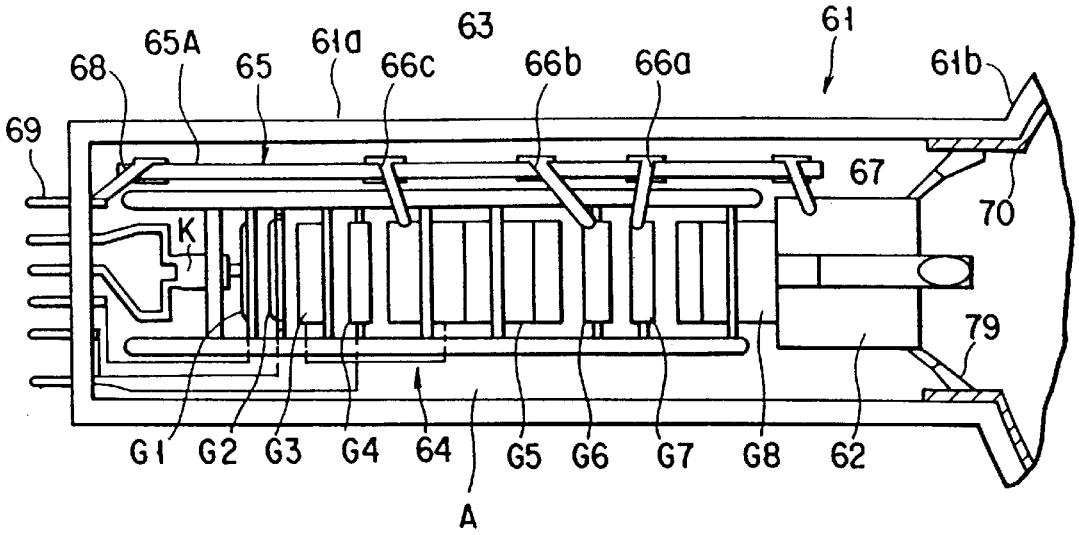
FIG. 1 is a schematic cross-section for explaining an example of an electron gun assembly for a cathode ray tube, according to the present invention.

The present inventors attempted to raise the formation speed of an dipole layer on an electron emission surface of an impregnated-type cathode assembly, to be higher than the speed at which the dipole layer is broken or scattered by an ion impact.

An electron emission substance impregnated in a porous cathode substrate is diffused along the surface of metal particles in the substrate from the inside of the metal substrate to the electron emission surface, and forms an dipole layer on the electron emission surface.

To shorten the time required until the electron emission substance is diffused and forms an dipole layer, the diffusion distance may be shortened. As a method of shortening the diffusion distance, there is an effective method of reducing the particle diameter of the metal of the substrate. For example, the particle diameter of W which is metal forming the substrate is generally 3 to 5 $\mu$m. The W particles are sintered and a large number of porous portions each having a size of 0.3 $\mu$m are formed between particles. An electron emission substance is diffused through these porous portions, and reaches the emission surface, thereby forming an dipole layer. If the dipole layer is broken by an ion impact, a new electron emission substance must be diffused through the porous and supplied to the entire emission surface. In this case, if the length of the porous portions through which the electron emission substance passes is short, the diffusion is accelerated, and a new electron emission substance is immediately compensated for, so that a sufficient electron emission characteristic is obtained and the emission is recovered.

The present invention has been made on the basis of the theory as described above, and the first aspect of the invention provides an impregnated-type cathode substrate which contains a large particle diameter low porosity region, and a small particle diameter high porosity region which is provided in the electron emission surface side of the large particle diameter low porosity region which has a smaller average particle diameter than the of the large particle diameter low porosity region and has a higher porosity than the large particle diameter low porosity region, with said cathode substrate being impregnated with an electron emission substance.

More specifically, the impregnated-type cathode substrate according to the first aspect of the invention contains at least a two-layered structure substantially consisting of a first region formed of sintered particles of a first average particles diameter and having a first porosity, and a second region provided at a part of an electron emission surface of the first region and having a second average particle diameter smaller than the first average particle diameter and a second porosity higher than the first porosity. Note that the first region is called a large particle diameter low porosity region, and the second region is called a small particle diameter low porosity region.

A porous cathode substrate used in the present invention contains, for example, a sintered body obtained by sintering powder of high melting point metal, e.g., W, molybdenum (Mo), rhenium (Re), or the like.

The term of "average particle diameter" is an average particle diameter of particles forming the sintered body as obtained above.

The entire porous cathode assembly may be impregnated with an electron emission substance, or regions of the assembly except for a part thereof, e.g., except for the vicinity of the electron emission surface, may be impregnated with the electron emission substance.

According to a first preferred embodiment of the first aspect of the invention, the large particle diameter low porosity region preferably has an average particle diameter of 2 to 10 $\mu$m and has a porosity of 15 to 25%.

More specifically, the impregnated-type cathode substrate according to the first preferred embodiment of the first aspect of the invention includes at least a two-layered structure substantially consisting of a large particle diameter low porosity region which is formed of sintered particles having an average particle diameter of 2 to 10 $\mu$m and has a porosity of 15 to 25%, and a small particle diameter high porosity region which is provided at at least a part of the electron emission surface and has a smaller average particle diameter than the average particle diameter of the large particles diameter low porosity region and a higher porosity than the porosity of the large particle diameter low porosity region.

According to a second preferred embodiment of the first aspect of the invention, the small particle diameter high porosity region preferably has an average particle diameter which is equal to or larger than 0.1 $\mu$m and is smaller than 2.0 $\mu$m, and has a porosity which is 25% to 40%.

More specifically, the impregnated-type cathode substrate according to the second preferred embodiment of the first aspect of the invention comprises a two-layered structure substantially consisting of a large particle diameter low porosity region and a small particle diameter high porosity region which is provided at at least a part of the electron emission surface of the large particle diameter low porosity region and which is formed of a sintered body made of particles having an average particle diameter which is equal to or larger than 0.1 $\mu$m and is smaller than 2 $\mu$m, and which has a porosity of 25 to 40%.

According to a third embodiment of the first aspect of the invention, the small particle diameter high porosity region preferably has a thickness of 30 $\mu$m or less.

More specifically, the impregnated-type cathode substrate according to the third preferred embodiment of the first aspect of the invention includes at least a two-layered structure substantially consisting of a large particle diameter low porosity region and a small particle diameter high porosity region which is provided at at least a part of the electron emission surface of the large particle diameter low porosity region and which has a thickness of 30 $\mu$m or less.

According to a fourth preferred embodiment of the first aspect of the invention, the small particle diameter high porosity region is preferably provided linearly or scattered in the electron emission surface side of the large particle diameter low porosity region.

More specifically, the impregnated-type cathode substrate according to the fourth preferred embodiment of the first aspect of the invention includes a structure substantially consisting of a large particle diameter low porosity region and a small particle diameter high porosity region which is provided linearly or scattered in the electron emission surface side.

According to a fifth preferred embodiment of the first invention, the average particle diameter and the porosity change in stages from the large particle diameter low porosity region to the small particle diameter high porosity region.

More specifically, the impregnated-type cathode substrate according to the fifth preferred embodiment of the first invention substantially has a structure in which the average particle diameter decreases in the thickness direction toward the electron emission surface side and in which the porosity increases toward the electron emission surface side.

According to a sixth preferred embodiment of the first aspect of the invention, at least one layer containing at least one kind of element selected from a group of iridium (Ir), osmium (Os), rhenium (Re), ruthenium (Ru), rhodium (Rh), and scandium (Sc) is further formed on the electron emission surface.

More specifically, the impregnated-type cathode substrate according to the sixth embodiment of the first aspect of the invention includes a layered structure consisting of at least three layers of a large particle diameter low porosity region, a small particle diameter high porosity region provided in the electron emission side, and at least one layer including at least one kind of element selected from a group of iridium, osmium, rhenium, ruthenium, rhodium, and scandium.

In the first aspect of the invention, the entire porous cathode substrate may be impregnated with an electron emission substance, or region of the substrate except for a part thereof, e.g., except for the vicinity of the electron emission surface, may be impregnated with an electron emission substance. Otherwise, only the large particle diameter low porosity region may be impregnated with an electron emission substance.

The second aspect of the invention provides a method of manufacturing an impregnated-type cathode, as a preferred method of manufacturing an impregnated-type cathode substrate according to the first aspect of the invention, said method comprising:

(1) a step of forming a porous sintered body having a large particle diameter and a low porosity;

(2) a step of obtaining a porous cathode pellet by forming a small particle diameter high porosity region in the electron emission surface side of the porous sintered body, said small particle diameter high porosity region having a smaller average particle diameter than the average particle diameter and a higher porosity than the porosity of the large particle diameter low porosity region;

(3) a step of cutting or punching the porous pellet, to form a porous cathode substrate; and (4) a step of impregnating the porous cathode substrate with an electron emission substance.

The small particle diameter high porosity region is preferably formed by a method selected from a group of a printing method, a spin-coating method, a spray method, an electrocoating method, and an elution method.

The third aspect of the invention relates to an improved version of the method according to the second aspect of the invention and provides a method of manufacturing an impregnated-type cathode substrate, characterized by comprising:

(1) a step of forming a porous sintered body having a large particle diameter and a low porosity;

(2) a step of obtaining a porous cathode pellet by forming a small particle diameter high porosity region in the electron emission surface side of the porous sintered body, said small particle diameter high porosity region having a smaller average particle diameter than the average particle diameter of the large particle diameter low porosity region and a higher porosity than the porosity of the large particle diameter low porosity region;

(3) a step of providing a filler selected from a group of metal and synthetic resin having a melting point of 1200° C. or less, in an electron emission surface side of the porous cathode pellet;

(4) a step of heating a formed resultant including the filler, at a temperature at which the filler can be melted, such that only the filler is melted;

(5) a step of cutting or punching the porous sintered body in a predetermined size, to form a porous cathode substrate, and of subjecting the porous cathode substrate to tumbling processing, thereby to remove burrs and contaminations;

(6) a step of removing the filler from the porous cathode substrate subjected to the tumbling processing; and (7) a step of impregnating the porous cathode substrate from which the filler has been removed, with an electron emission substance.

Note that the porous cathode pellet means a porous cathode substrate before being subjected to processing of cutting or punching the base into a porous cathode substrate having a predetermined shape.

According to the fourth aspect of the invention, there is provided a method of manufacturing an impregnated-type cathode substrate, characterized by comprising:

(1) a step of forming a sintered body made of high melting point metal as a large particle diameter low porosity region;

(2) a step of applying paste containing high melting point metal particle having a smaller average particle diameter than an average particle diameter of the large particle diameter low porosity region and at least one kind of filler selected from a group of metal and synthetic resin having a melting point of 1200° C. or less, to an electron emission surface side of the porous sintered body, and of performing baking at a temperature at which the filler can be melted, thereby to form a porous wintered body as a small particle diameter high porosity region and to melt the filler in the porous sintered body;

(3) a step of cutting or punching the porous sintered body in a predetermined size, to form a porous cathode substrate;

(4) a step of subjecting the porous cathode substrate to tumbling processing, to remove burrs and contaminations;

(5) a step of removing the filler from the porous cathode substrate subjected to the tumbling processing; and (6) a step of impregnating the porous cathode substrate with an electron emission substance.

Further, it is possible to form an impregnated-type cathode assembly with use of a porous cathode substrate thus obtained. Also, it is possible to form an electron tube with use of the impregnated-type cathode assembly.

The fifth invention provides a porous cathode assembly which uses the porous cathode substrate according to the first aspect of the invention and which is used for, for example, a porous cathode assembly for a cathode ray tube, a porous cathode assembly for a klystron tube, a porous cathode assembly for a traveling wave tube, and a porous cathode assembly for a gyrotron tube.

More specifically, the impregnated-type cathode assembly of the fifth invention is a porous cathode assembly comprising a porous cathode substrate which consists of a sintered body made of high melting point metal particle and which is impregnated with an electron emission substance, a support member for supporting the porous cathode substrate, and a heater provided in the support member, wherein the porous cathode substrate substantially consists of a large particle diameter low porosity region made of sintered particle and having a first porosity, and a small particle diameter high porosity region which is provided at least a part of an electron emission surface of the large particle diameter low porosity region and which has a second average particle diameter smaller than the first average particle diameter and a second porosity higher than the first porosity.

An impregnated-type cathode assembly according to a first embodiment of the fifth invention is a cathode assembly comprising a porous cathode substrate which is impregnated with an electron emission substance and is formed of a sintered body of high melting point metal powder, a support member for supporting the porous cathode substrate, and a heater provided in the support member, wherein the porous cathode substrate has at least a two-layered structure substantially consists of a large particle diameter low porosity region which is made of sintered particles having an average diameter of 2 to 10 $\mu$m and which has a porosity of 15 to 25%, and a small particle diameter high porosity region which is provided at least a part of an electron emission surface and has a porosity higher than the porosity of the large particle diameter low porosity region.

An impregnated-type cathode assembly according to a second embodiment of the fifth invention is a cathode assembly comprising a cathode substrate which is impregnated with an electron emission substance and is formed of a porous sintered body of high melting point metal particle, a support member for supporting the porous cathode substrate, and a heater provided in the support member, wherein the porous cathode substrate has at least a two-layered structure substantially consists of a large particle diameter low porosity region and a small particle diameter high porosity region which is provided at least a part of an electron emission surface of the large particle diameter low porosity region and which contains a sintered body made of particles having an average particle diameter which is 0.1 $\mu$m or more and is less than 2.0 $\mu$m, said small particle diameter high porosity region having a porosity of 25 to 40%.

An impregnated-type cathode assembly according to a third embodiment of the fifth invention is a cathode assembly comprising a porous cathode substrate having a two-layered structure substantially consisting of a large particle diameter low porosity region and a small particle diameter high porosity region, a support member for supporting the cathode substrate, and a heater provided in the support member, said small particle diameter high porosity region being provided at least a part of an electron emission surface of the large particle diameter low porosity region and having a thickness of 30 $\mu$m or less.

An impregnated-type cathode assembly according to a fourth embodiment of the fifth invention is a cathode assembly comprising a porous cathode substrate having a two-layered structure substantially consisting of a large particle diameter low porosity region and a small particle diameter high porosity region, a support member for supporting the cathode substrate, and a heater provided in the support member, said small particle diameter high porosity region being provided linearly or scattered in an electron emission surface side of the large particle diameter low porosity region.

An impregnated-type cathode assembly according to a fifth embodiment of the fifth invention is a cathode assembly comprising a porous cathode substrate, a support member for supporting the cathode substrate, and a heater provided in the support member, said porous cathode substrate substantially having a layered structure substantially consisting of three or more layers of a large particle diameter low porosity region, a small particle diameter high porosity region provided in an electron emission surface side, and at least one layer containing at least one kind of element selected from a group of iridium, osmium, rhenium, ruthenium, rhodium, and scandium.

In case where the cathode assembly according to the fifth invention is used for a cathode ray tube, the cathode assembly includes, for example, a cylindrical cathode sleeve, an impregnated-type cathode substrate fixing member fixed to an inner surface of an end portion of the cathode sleeve, an impregnated-type cathode substrate according to the first embodiment fixed to the impregnated-type cathode substrate fixing member, a cylindrical holder provided coaxially outside the cathode so as to surround the cathode sleeve, a plurality of straps each having an end portion fixed to the outside of the cathode sleeve and another end portion fixed to the inside of the cylindrical holder, and a heater provided inside the cathode sleeve.

In case where the cathode assembly according to the fifth invention is used for a klystron tube, the cathode assembly includes, for example, an impregnated-type cathode substrate, a support cylinder for supporting the impregnated-type substrate, a heater included in the support cylinder and embedded in an insulating material.

A sixth aspect of the invention uses a porous cathode substrate according to the first aspect of the invention to provide an electron gun assembly for a cathode ray tube, a klystron tube, a traveling wave tube, and a gyrotron tube.

In case where the electron gun assembly according to the sixth aspect of the invention is an electron gun assembly for a cathode ray tube, the assembly includes, for example, an impregnated-type cathode assembly according to the fifth invention, a plurality of grid electrodes coaxially provided in an electron emission surface side of the impregnated-type cathode assembly, an electron gun having a convergence electrode coaxially provided in front of the plurality of grid electrodes, and a resistor as a voltage divider connected to the electron gun.

FIG. 1 is a schematic cross-section showing a color picture tube incorporating a resistor included in an electron tube, as an example of the electron gun assembly for a cathode ray tube according to the sixth aspect of the invention.

In FIG. 1, the reference 61 denotes a vacuum container, and an electron gun assembly A is provided inside a neck portion 61*a* formed in the vacuum container 61. In the electron gun assembly A, a first grid electrode G1, a second grid electrode G2, a third grid electrode G3, a fourth grid electrode G4, a fifth grid electrode G5, a sixth grid electrode G6, a seventh. grid electrode G7, and an eighth grid electrode G8 are coaxially formed in this order, commonly with respect to three cathodes. A convergence electrode 62 is provided in the rear stage behind the after the grid electrode G8.

The grid electrodes G1, G2, G3, G4, G5, G6, G7 and G8 maintain a predetermined positional relationship, and are mechanically held by bead glass 3. In addition, the third grid electrode G3 and the fifth grid electrode G5 are electrically connected with each other by a lead line 64. The convergence electrode 62 is connected with the eighth grid electrode by welding.

In this electron gun assembly A, a resistor 65 incorporated in an electron tube is provided. This resistor 65 comprises an insulating board 65A. A resistor layer (not shown) and an electrode layer connected to this resistor layer are formed on this insulating board 65A. The insulating board 65A of this resistor 65 is provided with terminals 66*a*, 66*b*, and 66*c* for drawing high voltage electrodes to be connected to the electrode layer, and the terminals 66*a*, 66*b*, and 66*c* are respectively connected to the seventh grid electrode G7, sixth grid electrode G6, and fifth grid electrode G5. A terminal 67 provided on the insulating board 65A of the resistor, 65 and connected to the electrode layer is connected to the convergence electrode 62, and a drawing terminal 68 of the earth side which is provided on the insulating board 65A and connected to the electrode layer is connected to the earth electrode pin 69.

Meanwhile, a graphite conductive film 70 extending to the inner wall of the neck portion 61*a* is coated on the inner wall of a funnel portion 61*b* of the vacuum container 61, and the graphite conductive film 70 is supplied with an anode voltage through a high voltage supply button (which is an anode button not shown).

Further, the convergence electrode 62 is provided with a conductive spring 79, and the conductive spring 79 is brought into contact with the graphite conductive film 70, so that an anode voltage is supplied to the eight grid electrode G8 through the convergence electrode 62 and to the convergence terminal 67 of the resister 65 incorporated in the electron tube, and divisional voltages generated at the electrodes 66*a*, 66*b*, and 66*c* of a high voltage are respectively supplied to the seventh grid electrode G7, sixth grid electrode G6, and fifth grid electrode G5.

In case where the electron gun assembly according to the sixth aspect of the invention is an electron gun assembly for a klystron tube, the assembly includes an impregnated-type cathode assembly according to the fifth invention, a cathode portion incorporating the impregnated-type cathode assembly, and an anode portion coaxially provided on the electron emission surface of the impregnated-type cathode assembly.

Figure 2:
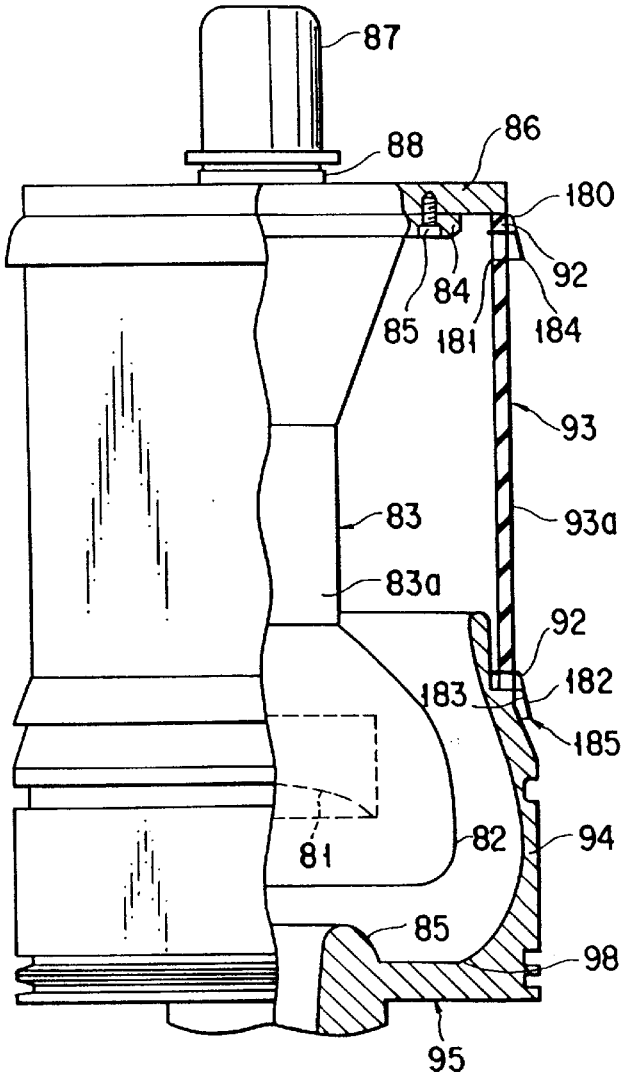
FIG. 2 is a schematic cross-section for explaining a main part of an example of an electron gun assembly for a klystron tube, according to the present invention.

FIG. 2 is a schematic cross-section for explaining a main part of an example of an electron gun assembly for a klystron tube according to the sixth aspect of the invention.

As shown in FIG. 2, in the main part of the example of an electron gun assembly for a klystron tube, a cathode portion 181 where a cathode assembly 81 is provided and an insulating portion 93 are sealed by a welding flange 180 formed of a thin metal ring engaged and tapered along the axial direction, and by an arc welding sealing portion 184 at the top end of the cathode portion 181. In addition, the insulating portion 93 and the anode portion 95 are air-tightly sealed by a welding flange 182 formed of a thin metal ring engaged and tapered along the axial direction and by a top arc welding sealing portion of the portion 183. In order to assembly the electron gun assembly while defining the distances of electrodes to the anode portion 95, the insulating portion 93 and the anode portion 95 are engaged with each other finally, and are air-tightly sealed by the welding sealing portion 98.

In general cases, a difference in electrode distances from designed dimensions can be cited as a drawback of an electron gun assembly which may seriously affect the operation of a klystron tube. The difference is mainly caused by precision of components and precision of assembly. Therefore, the electrode distances are adjusted in the following manner. Specifically, as for a difference in the axial direction, an appropriate conductive spacer is inserted between a stem plate 84 of the cathode portion and a stem end plate 86, and is fixed by a screw 85, or a spacer is inserted between a back-up ceramics ring 92 and a welding flange 180 or 183. As for a difference in the radial direction, an axial adjustment with respect to a Wehnelt member 82 and a welding flange 180 is carried out with use of a rotation base tool, and thereafter, the cathode portion 83 is fixed by a screw 85. As for the insulating portion 93, brazing is carried out with use of an appropriate assembly tool so that the welding flanges 181 and 182 obtain a concentricity.

In addition, the seventh aspect of the invention uses an impregnated-type cathode substrate according to the first aspect of the invention to provide an electron tube used for, for example, a cathode ray tube, a klystron tube, a traveling tube, and a gyrotron tube.

In case where the electron tube according to the seventh aspect of the invention is used for a cathode ray tube, the electron tube includes, for example, a vacuum outer envelope having a face portion, a fluorescent layer provided on an inner surface of the face portion, an electron gun assembly according to the sixth aspect of the invention and provided at a position opposite to the face portion of the vacuum outer envelope, and a shadow mask provided between the fluorescent layer and the electron gun assembly.

Figure 3:
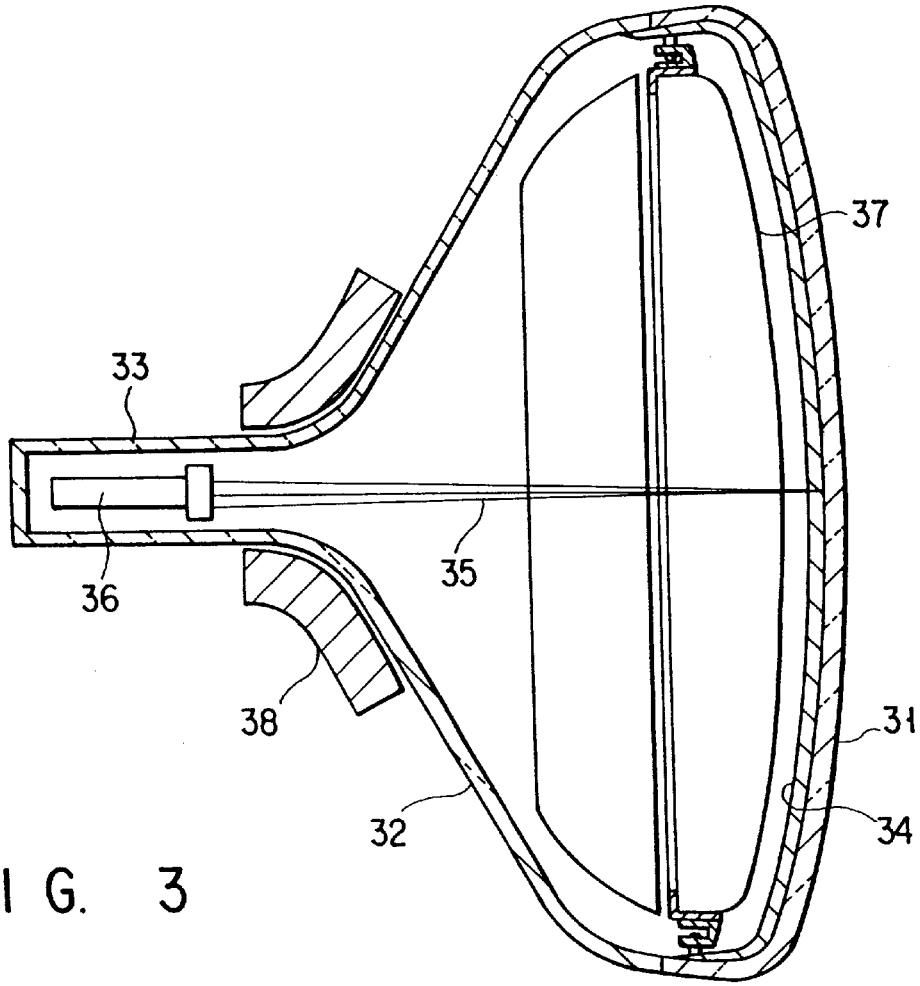
FIG. 3 is a schematic cross-section for explaining an example of an electron tube for a cathode ray tube, according to the present invention.

FIG. 3 is a schematic cross-section for explaining an example of an electron tube for a cathode ray tube according to the present invention.

As shown in FIG. 3, the electron tube for this cathode ray tube has an outer envelope consisting of a rectangular panel 31, a funnel 32, and a neck 33. On the inner surface of the panel 31, a fluorescent layer 34 which emits light in red, green, and blue is provided like stripes. In the neck 33, an in-line type electron gun 36 which injects electron beams 35 corresponding colors of red, green, and blue is provided, and the electron gun 36 is constituted by arranging electron gun assembly as shown in FIG. 1 in line. At a position adjacent to and opposite to the phosphor member 34, a shadow mask 7 having a number of fine opening holes is supported by and fixed to a mask frame 38. An image is reproduced by deflecting electron beams by a deflecting device 38, thereby to perform scanning.

In case where the electron tube is used for a klystron tube, the electron tube includes an electron gun assembly according to the sixth aspect of the invention, a high frequency acting portion and a collector portion in which a plurality of resonance cavities arranged coaxially in an electron emission surface side of the electron gun assembly are connected by a drift tube, and a magnetic field generator device provided in an outer peripheral portion of the high frequency acting portion.

Figure 4:
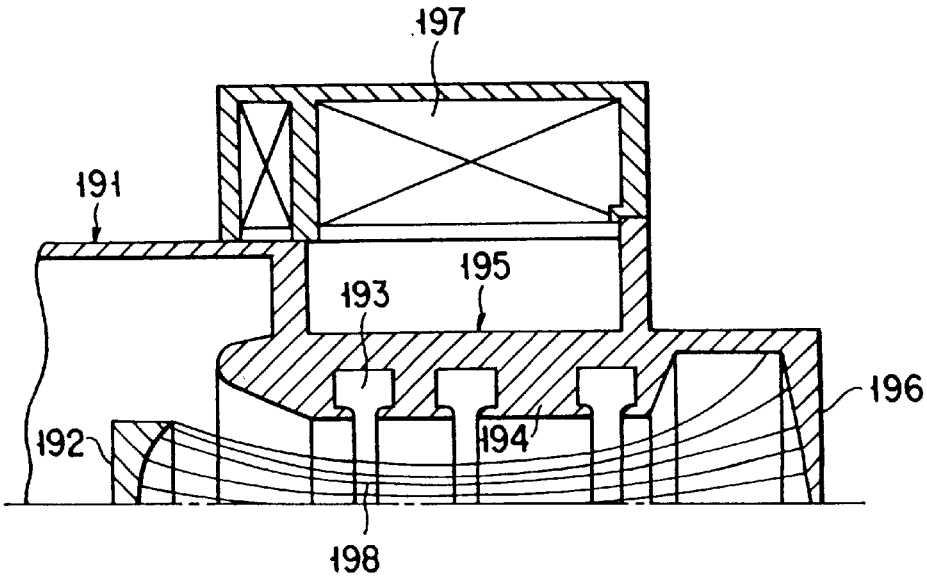
FIG. 4 is a schematic cross-section for explaining a main part of an example of an electron tube for a klystron tube, according to the present invention.

FIG. 4 is a schematic cross-section for explaining a main part of an example of an electron tube for a klystron tube according to the present invention.

As shown in FIG. 4, in the main part of the electron tube for a klystron tube, the reference 191 denotes an electron gun portion, and the reference 192 denotes a cathode assembly. A high frequency acting portion 195 in which a plurality of resonance cavities 193 are connected by a drift tube 194 and a collector portion 196 are connected in this order with an electron gun portion having a structure as shown in FIG. 2. Further, a magnetic field generator device, e.g., an electromagnet coil 197 is provided outside the high frequency acting portion 195. Note that the reference 198 denotes an electron beam. In addition, the output waveguide portion is omitted from the figure.

In case where the electron gun according to the seventh aspect of the invention is used for a traveling wave tube, the electron tube includes an electron gun assembly using an impregnated-type cathode assembly according to the present invention, a slow-wave circuit for amplifying a signal provided coaxially in an electron emission surface side of the impregnated-type cathode assembly, and a collector portion for capturing an electron beam.

Figure 5:
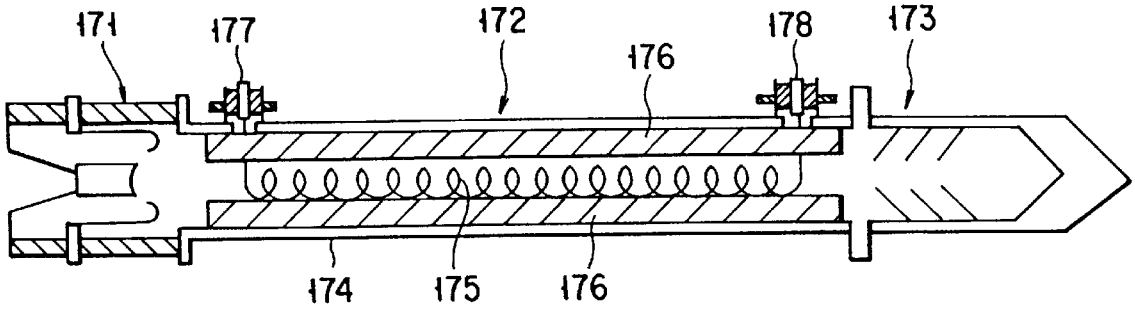
FIG. 5 is a schematic cross-section for explaining an example of an electron tube for a traveling wave tube, according to the present invention.

FIG. 5 is a schematic cross-section for explaining an example of an electron tube for a traveling wave tube according to the present invention.

As shown in FIG. 5, this traveling wave tube comprises an electron gun 171, a slow-wave circuit (or high frequency acting portion) 172 for amplifying a signal, and a collector 173 for capturing an electron beam. The slow-wave circuit 172 is constituted such that a helix coil 175 is supported by and fixed to three dielectric support rods 176 in a pipe-like vacuum envelope 174, and an input contact plug 177 and an output contact plug 178 are projected at both ends of the slow-wave circuit 172.

In case where electron tube according to the seventh aspect of the invention is used for a gyrotron, the electron tube includes, for example, an electron gun assembly using an impregnated-type cathode assembly according to the present invention, a tapered electron beam compressing portion which is provided in an electron emission surface side of the impregnated-type cathode assembly and whose diameter gradually decreases, a cavity resonance portion arranged to be continuous to the tapered electron beam compressing portion, a tapered electromagnetic waveguide portion which is arranged to be continuous to the cavity resonance portion and whose diameter gradually increases, a collector portion for capturing an electron beam, and a magnetic field generator device provided at an outer peripheral portion of the cavity resonance portion.

Figure 6:
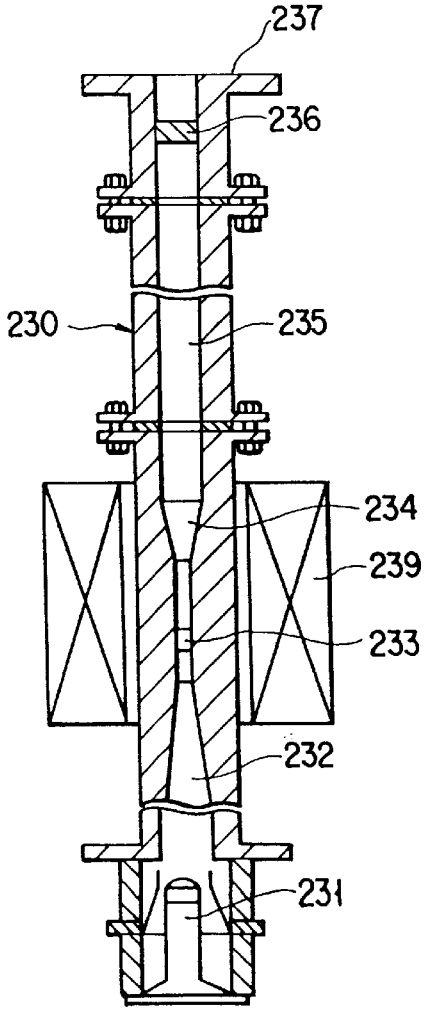
FIG. 6 is a schematic cross-section for explaining an example of an electron tube for a gyrotron tube, according to the present invention.

FIG. 6 is a schematic cross-section for explaining an example of an electron tube for a gyrotron tube according to the present invention.

In FIG. 6, the reference 230 denotes a body of a gyrotron tube, and the reference 231 denotes a hollow electron gun portion which is assembled with use of an impregnated-type cathode assembly and generates an electron beam. The reference 232 denotes a tapered electron beam compressing portion which is provided in the down stream side of the electron beam and whose diameter gradually decreases, and the reference 233 denotes a tapered electromagnetic wave guide portion which is provided in the down stream side of the compressing portion and whose diameter gradually decreases. The reference 235 denotes a collector portion which is provided behind the wave guide portion and captures an electron beam after interaction is performed. The reference 236 denotes an output window which is provided in the down stream side of the collector portion and has a ceramics air-tight window. The reference 237 denotes a waveguide tube connection flange, and the reference 239 denotes a solenoid valve of a magnetic field generator device.

The first aspect of the invention will now be explained below.

In the first aspect of the invention, a porous region having a small particle diameter and a high porosity and a porous region having a large particle diameter and a low porosity are provided in this order from at least the electron emission side of the impregnated-type cathode assembly.

In the large particle diameter low porosity region, supply of an impregnated electron emission substance can be maintained constant during heating.

In addition, since the small particle diameter high porosity region is provided on the large particle diameter low porosity region, distances between particles forming the cathode substrate are short within the small particle diameter high porosity region in the electron emission surface side, so that the diffusion distance of the electron emission substance is shortened. Therefore, the electron emission substance covers the electron emission surface more rapidly and uniformly, so that sufficient supply of an electron emission substance and a sufficient covering rate concerning the electron emission surface can be achieved. As the covering rate is improved, the ion-impact resistance becomes more excellent. In this manner, the aging time of an impregnated-type cathode assembly which can be operated at a high voltage can be shortened. In addition, even if an electron emission substance whose diffusion speed is low is contained, deterioration in electron emission characteristic of the impregnated-type cathode assembly due to an ion impact can be prevented.

The term of "porosity" used in the present invention is a rate of a space existing in an object (solid) of a constant volume, and is expressed by the following relation (1).

$$P1-W/Vd \quad (1)$$

In this relation, w is a weight (g) of an object to be measured, and V is a volume ($cm^3$) of an object to be measured, is a density of an object to be measured (e.g., 19.3 $g/cm^3$ when the object is tungsten), and P is a porosity (%). However, a small particle high porosity region required in the present invention is preferably a layer state. Further, this layer preferably has a thickness of 30 $\mu$m or less. Therefore, it is substantially impossible to actually measure the values of w and V, so that the porosity cannot be calculated. To control actually the porosity, the porosity can be measured in the following method.

At first, in case of a cathode substrate after impregnation, all the electron emission substance in pores is removed, and thereafter, colored resin is melted and impregnated in these pores. Thereafter, polishing is performed by a metal polisher or the like, to form a vertical cross-section on the cathode surface. When the size of the cathode substrate is large, the cathode may be previously cut to prepare a rough cross-section. After a smooth cross-section is attained, the image of the cross-section is photographed by an optical microscope or an electronic microscope. The image of this cross-section is subjected to image processing, for example, by CV-100 available from KEYENCE, to obtain the area $S_{base}$ of a portion where the high melting point metal appears and the area $S_{base}$ of a portion where colored resin appears. Then, $P=S_{pore}/(S_{pore}+S_{base})\times 100$ (%) can be used as a porosity. Here, the boundary between the region $S_{pore}$ and the outer region of the cathode substrate is a line segment connecting points of high melting point metal particles which exist in the outermost circumference of the cathode substrate and project to the outermost portion from the cathode substrate. Although calculation of the area $S_{base}$ and the area $S_{pore}$ is preferably performed with respect to the entire surface of the cathode substrate, it is practically difficult to carry out this calculation. Therefore, at least five points are arbitrarily selected on the cross-section of the cathode substrate, and the area $S_{base}$ and the area $S_{pore}$ are obtained with respect to an area of 1000 $\mu m^2$ or more in the vicinity of each of the points. The value of P calculated from the average values can be used as a porosity.

In the first preferred embodiment of the first aspect of the invention, closed pores cannot be neglected as the sintering proceeds during manufacturing steps, so that there are no advantages for impregnation of an electron emission substance even though a certain porosity can be obtained, if the particle diameter of the large particle diameter low porosity region is 2 $\mu$m or less. If the particle diameter exceeds 10 $\mu$m, a desired porosity cannot be obtained, so that supply of an electron emission substance to the small particle diameter high porosity region is insufficient, and there is a tendency that the sintering temperature become extremely high to obtain a desired porosity. Also, there is a tendency that industrial manufacture is difficult. A preferable average particle diameter of the large particle diameter low porosity region is 2 to 7 $\mu$m, and a more preferable average particle diameter is 2 to 5 $\mu$m. If the porosity is 15% or less, there is a tendency that supply of an electron emission substance to the small particle diameter high porosity region is insufficient. If the porosity exceeds 25%, a necessary strength cannot be obtained and consumption of an electron emission substance is increased so that the life-time is shortened. A preferable porosity of the large particle diameter low porosity region is 15 to 22%, and a more preferable porosity is 17 to 21%.

In the second preferred embodiment of the first aspect of the invention, if the average particle diameter of the small particle diameter high porosity region is 0.1 $\mu$m or less, the particle diameter is so small that the cathode substrate is easily cracked and the strength is lowered. Further, if the particle diameter of high melting point metal as raw material is too small, secondary or tertiary particles are formed during sintering so that the sintering easily prosecutes and a desired particle diameter cannot be obtained. In this case, there is a tendency that the density is increased and a desired porosity cannot be obtained.

In addition, if the particle diameter is 2 $\mu$m or more, the diffusion distance of the electron emission substance is large, so that it takes a long time to supply the electron emission surface with a sufficient electron emission substance. Further, if the diffusion distance is large, it is difficult to obtain uniform diffusion on the electron emission surface. Hence, it can be found that the covering rate of the electron emission substance on the electron emission surface decreases. As described above, a sufficient ion-impact resistance cannot be obtained if the covering rate decreases.

A more preferable average particle diameter of the small particle diameter high porosity region of the porous cathode substrate is 0.8 to 1.5 $\mu$m.

If the porosity is 25% or less where the average particle diameter of the small diameter high porosity region is within a range of 0.1 $\mu$m to 2.0 $\mu$m, there is a tendency that an electron emission substance cannot be sufficiently supplied to the electron emission surface and the covering rate of the electron emission substance on the electron emission surface decreases. If the covering rate decreases, a sufficient ion-impact resistance cannot be obtained.

If the porosity is high and exceeds 40% where the average particle diameter of the cathode substrate is within a range of 0.1 $\mu$m to 2.0 $\mu$m, the mechanical strength of the cathode substrate tends to decrease. A more preferable porosity of the small particle diameter high porosity region is 25 to 35%.

In case of an impregnated-type cathode substrate having a layered structure comprising of at least two layers as shown in the third preferred embodiment of the first aspect of the invention, the layer thickness of the small particle diameter high porosity region provided in the electron emission surface side of the large particle diameter low porosity region is preferably 30 $\mu$m. This layer thickness is more preferably 3 to 30 $\mu$m, and is most preferably 3 to 20 $\mu$m.

As shown in the second aspect of the invention, the impregnated-type cathode assembly having at least two-layered structure can be manufactured in the following manner.

At first, a normal method is used to form a porous sintered body as a large particle diameter low porosity region which has an average particle diameter of 2 to 10 $\mu$m and a porosity of 15 to 20%.

In the next, high melting point metal of powder W having an average particle diameter smaller than the average particle diameter of a porous sintered body as a large particle diameter low porosity region is prepared in form of paste together with an organic solvent, on the electron emission surface of the porous sintered body, and is applied by a screen printing method, to have a desired thickness. Thereafter, the paste is dried and is subjected to sintering within a temperature range of 1700 to 2200° C., in a vacuum atmosphere or a reducing atmosphere using hydrogen ($H_2$). Thus, a small particle diameter high porosity region is formed on the large particle diameter low porosity region. In this case, the density of paste, printing conditions, and the sintering time may be appropriately set such that the particles forming the sintered body have a desired average particles diameter and a desired porosity.

In addition, as another structure of a cathode substrate according to the first aspect of the invention, a structure can be cited in which a plurality of small particle diameter high porosity regions are scattered at least in the electron emission side of a matrix formed of a large particle diameter low porosity region, as shown in the fourth preferred embodiment. For example, a concave portion exists like a groove or a hole in the electron emission surface of the large particle diameter low porosity region, and the small particle diameter high porosity region exists in the concave portion. To form a cathode assembly having such structure, a groove-like or hole-like concave portion is formed in the electron emission surface side of the porous sintered body as the large particle diameter low porosity region, by mechanical processing or the like, and paste is filled in the concave portion. The paste is subjected to sintering to form a small particle diameter high porosity region.

Further, as another modification of the structure of the cathode substrate, a structure can be cited in which the porosity gradually increases in the thickness direction toward the electron emission surface, while the particle diameter gradually decreases in the same direction, as shown in the fifth preferred embodiment of the first invention.

Formation of the small particle diameter high porosity region is not limited to the printing method described above, but any method including a spin coating method, a spray method, an electrocoating method, and an elution method can be adopted as long as a porous layer can be obtained by such a method. In case where the elution method is adopted, a sintering step can be omitted.

As for the cathode substrate of a cathode assembly having the structure as described above, for example, an electron emission substance made of a mixture substance which has a mole ratio of BaO: CaO: $Al_2O_3$ is 4:1:1 is melted and impregnated in a reducing atmosphere of hydrogen $H_2$.

Further, the sixth preferred embodiment of the first aspect of the invention will be explained below.

The at least one kind of element selected from a group of iridium (Ir), osmium (Os), rhenium (Re), ruthenium (Ru), rhodium (Rh), and scandium (Sc) which is used in the sixth preferred embodiment of the first aspect of the invention can be used-in single use, in form of a substance containing the selected element, or in combination with another element or with a substance containing another element.

The combination includes a case where different elements exists independently from each other and a case where different elements exist in form of an alloy or a compound.

According to the sixth preferred embodiment, since a layer containing those elements is formed, electron emission characteristic can be rapidly recovered so that emission and sufficient low temperature operation are enabled even when an dipole layer on the electron emission surface of the cathode assembly is broken. In addition, since low temperature operation is achieved, an amount of an evaporation electron emission substance such as barium or the like can be lowered and the thickness of the cathode assembly can be thin.

Elements which are preferably used in single use are iridium and scandium.

Substances containing preferable elements are scandium oxide ($SC_2O_3$) and scandium hydride ($ScH_2$).

Preferable combinations of elements are alloys of Ir—W, Os—Ru, $Sc_2O_3$—W, Sc—W, $ScH_2$—W, Sc—Re.

Although Os can be singly used in view of its functions, it is more preferable to use Os in form of alloy which is less oxidized rather than in single use, in view of safety of operators, since oxide material of Os is poisonous.

Sc can be used in combination with at least one kind of element selected from a group of high melting point metal such as hafnium (Hf), rhenium (Re), ruthenium (Ru), and the likes. These kinds of high melting point metal serve as a segregator which prevents Sc from oxydization during operation of a cathode assembly.

In addition, in the first aspect of the invention, excessive element emission substances are removed from the surface of the porous cathode substrate if necessary, and thereafter, a layer of element components to be used can be formed by a thin film formation means such as a sputtering method or the like.

The third aspect of the invention and the fourth aspect of the invention will further be explained below.

The third aspect of the invention and the fourth aspect of the invention are to improve a step of cutting a cathode substrate having a predetermined form from a porous body, in a manufacturing method of a porous cathode assembly. A cut out cathode substrate has burrs. Therefore, the cathode substrate is subjected to tumbling processing to remove burrs. Normally, tumbling processing is carried out by shaking a cut out cathode substrate together with small balls made of alumina and silica in a container, thereby rubbing the small ball and the cathode substrate with each other. In this state, the electron emission surface side can be rubbed in the same manner, so that pore portions of the porous body are closed. Since the porous portions are supply paths for an electron emission substance, there issues a problem that impregnation of the electron emission substance is prevented if the pore portions are closed. in addition, the apparent surface area of the porous body surface is increased, resulting in a problem that the diffusion distance of the electron emission substance on the surface is increased. Particularly, in a cathode substrate having a small grin diameter high porosity region, shortening of the diffusion distance of an electron emission substance and enlargement of supply paths are affected due to those problems, so that advantageous improvements in the ion-impact resistance characteristic cannot be attained.

In addition, when the surface of a cathode substrate is pealed, an electron emission substance blows out, thereby causing quality deterioration in the electron emission surface. The quality deterioration in the electron emission surface cause an influence such as a deterioration in the emission current density.

According to the third aspect of the invention, a filler selected from metal and synthetic resin having a melting point of 1200° C. or less is applied to the surface of the electron emission surface of the porous body before a cathode substrate is cut and processed, and is subjected to a heating treatment, to melt the filler in the porous body forming material. As a result, the filler is melted into the porous body through pore portions in the electron emission surface. In this manner, the inside of the pores and the porous body are reinforced, so that pore portions are not closed even when the electron emission surface is rubbed during tumbling processing.

According to the fourth aspect of the invention, paste containing high melting point metal and at least one kind of filler selected from a group of metal and synthetic resin having a melting point of 1200° C. or less is sintered at a temperature at which the filler can be melted, to form a porous body containing high melting point metal as a main component and to melt the filler into the pores of the porous body. As a result of this, the inside of the pores and the porous body are reinforced, so that the pore portions are not closed even when the electron emission surface is rubbed during tumbling processing.

In addition, as an example of application of the cathode substrate according to the present invention, a mixture layer of fine powder of high melting point metal and scandium oxide can further be formed on the electron emission surface region of the cathode substrate. As a result of this, the electron emission characteristic can be rapidly recovered and emission and sufficient low temperature operation can be enabled again, even when an electric double layer on the electron emission surface of the cathode substrate is broken by an ion impact. In addition, since low temperature operation is thus enabled, the evaporation amount of an electron emission substance such as barium or the like can be reduced to be low, so that the thickness of a cathode substrate can be set to be thinner than a conventional case. This also means that the life-time characteristic of a conventional power-saving impregnated-type cathode can be greatly improved, which would otherwise be insufficient due to shortage in impregnation amount of an electron emission substance.

Further, it is preferable that an alloy of tungsten and molybdenum or a mixture there of can be used as fine powder of high melting point metal. As a result of this, a sintered layer which is sufficiently strong can be obtained at a low sintering temperature. As synthetic resin, it is preferable to use methyl methacrylate.

A sintered layer of fine powder thus obtained preferably has an average particle diameter of 0.8 to 1.5 $\mu$m, and also preferably has a porosity of 20 to 40% and more preferably has a porosity of 25 to 35%.

In the following, the present invention will be specifically explained with reference to the drawings.

EMBODIMENT 1

Figure 7:
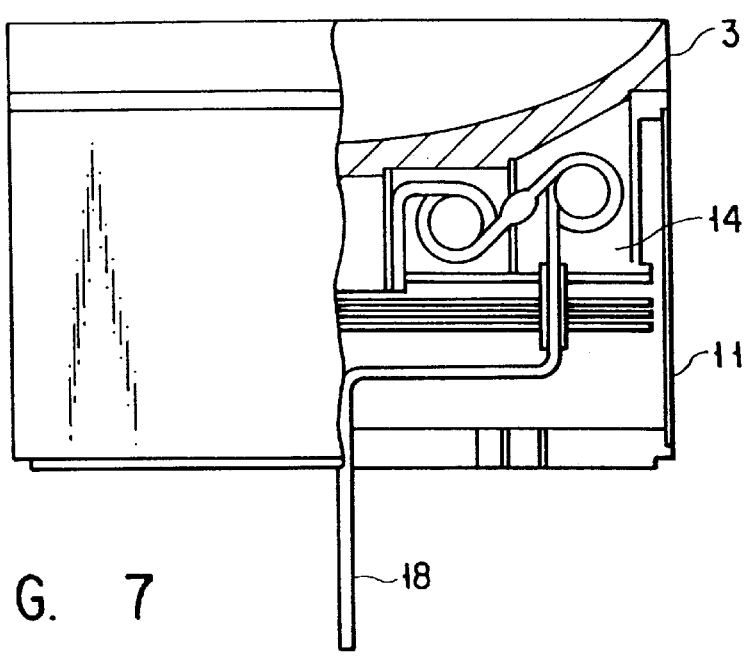
FIG. 7 is a partially cut schematic view showing a first example of an impregnated-type cathode assembly, according to the present invention.

FIG. 7 is a partially cut schematic view showing an example of an electron tube using the first embodiment of the impregnated-type cathode assembly according to the present invention. This cathode assembly is an impregnated-type cathode assembly for a klystron tube and is used with a high output and a high voltage.

As shown in the figure, this electron tube mainly comprises, for example, a metal substrate 3 made of porous material W, a support cylinder 11 made of Mo or the like brazed so as to support the porous cathode substrate 3, and a heater 18 incorporated in the support cylinder 11. The heater 18 is fixed in such a manner in which the heater is embedded in a potting material and is subjected to sintering. Pore portions of the porous cathode substrate 3 is impregnated with an electron emission substance whose mole ratio of BaO: CaO: $Al_2O_3$ is 4:1:1. A thin film layer of Ir is provided on the electron emission surface side of the porous cathode substrate 3, by means of sputtering, and an alloy layer of Ir and W not shown is formed by means of alloying processing. In addition, this cathode assembly has a curvature of, for example, a radius 53 mm for the purpose of focusing.

Figure 8:
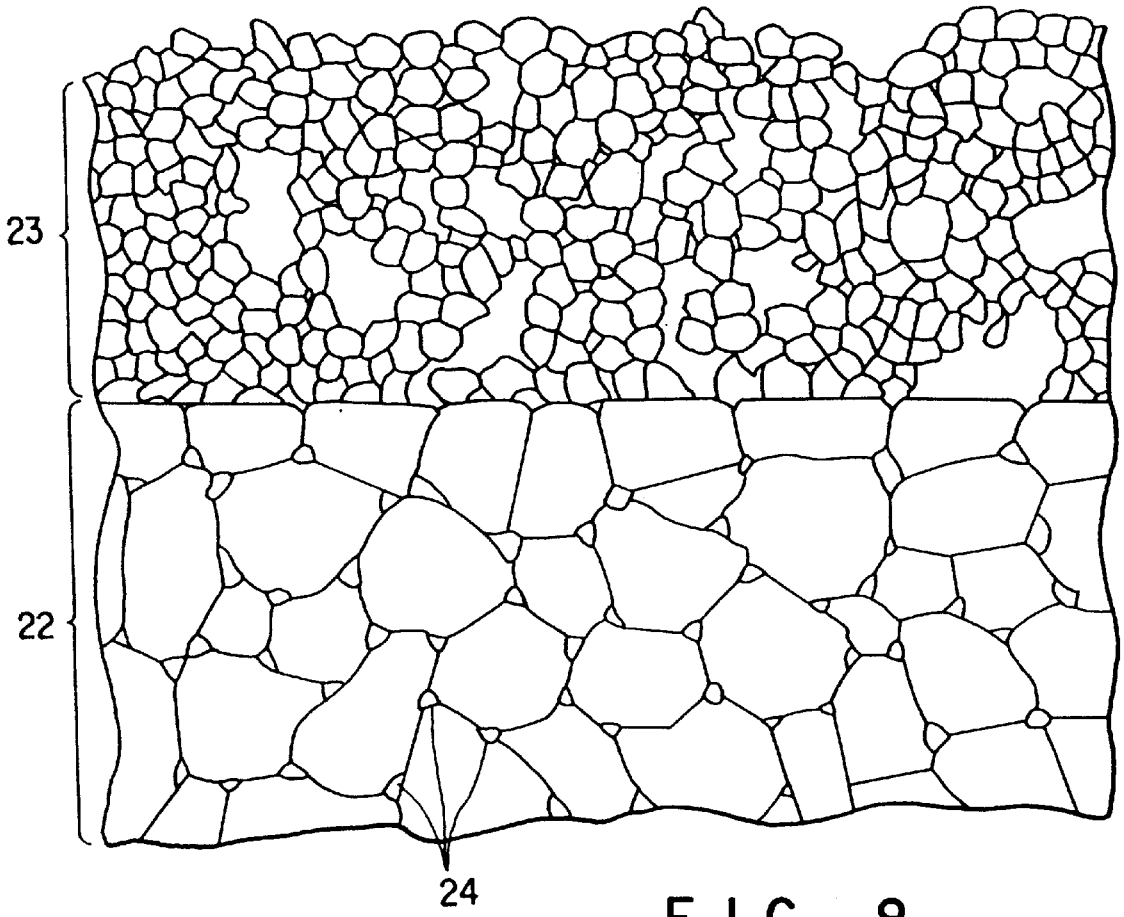
FIG. 8 is a model view showing a structure of the impregnated-type cathode of FIG. 7.

FIG. 8 is a model view showing a structure of the porous cathode substrate 3 of the cathode assembly. The porous cathode substrate 3 has a two-layered structure consisting of a large particle diameter low porosity layer 22 and a small particle diameter high porosity layer 23 formed thereon, as is shown in FIG. 8. The porous cathode substrate 3 having this structure can be formed by a spraying method as will be described below.

At first, for example, a porous W base which is made of particles having an average particle diameter of about 3 $\mu$m and which have a porosity of about 17% is prepared as a large particle diameter low porosity layer. This substrate has, for example, a diameter of 70 mm and has an electron emission surface whose curvature radius is 53 mm.

With this porous W base equipped with a mask tool, a mixture of W particles, butyl acetate, and methanol is sprayed vertically onto the electron emission surface of the substrate, by means of a spray gun.

While the spraying distance was set to 10 cm, the air pressure was set to 1.2 kgf/cm$^2$, the spraying flow amount was set to 0.35 cc/sec, and the spraying time was set to 5 seconds, a thin film layer having a thickness of 20 $\mu$m was uniformly formed on the electron emission surface having a curvature.

Thereafter, a heat treatment for one hour was carried out for the purpose of sintering of the thin film layer and adhesion of the thin film layer and the substrate metal, in a reducing atmosphere at a temperature of 1700 to 2200° C., e.g., in a hydrogen atmosphere at a temperature of 2000° C.

A small particle diameter high porosity W thin film layer thus obtained was not cracked, and has a sufficient strength. The layer had an average particle diameter of 0.8 $\mu$m, a porosity of 30%, and an uniform thickness of about 10 $\mu$m.

In the next, an electron emission substance of a mixture whose mole ratio of BaO: CaO: $Al_2O_3$ is 4:1:1 was melted and impregnated in pore portions of the porous substrate 3, by performing heating in an atmosphere of $H_2$ at a temperature of 1700° C. for about 10 minutes.

A cathode substrate having a two-layered structure thus obtained was set in a klystron electron tube, and was subjected to aging under condition that the cathode temperature was 1000° C. b (° C. b is a brightness temperature).

Figure 9:
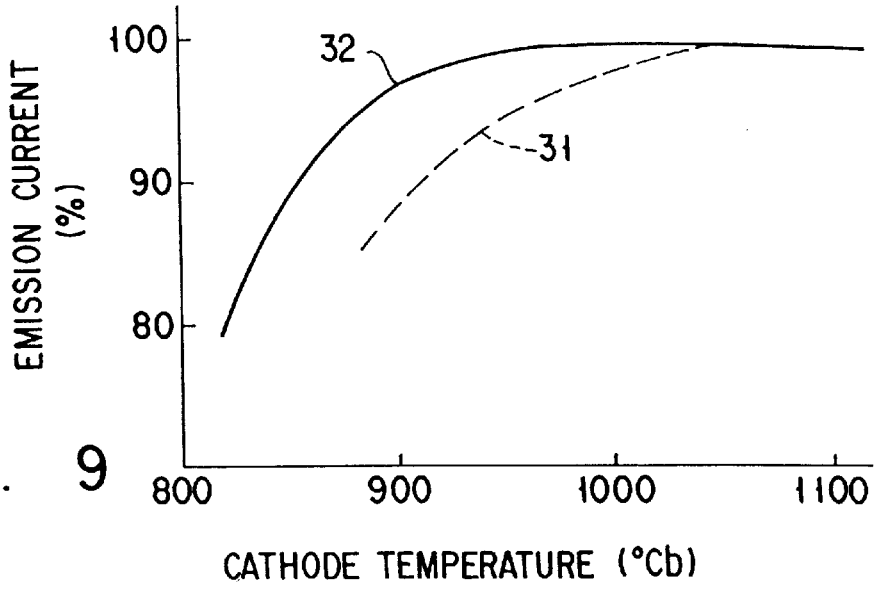
FIG. 9 is a graph showing the electron emission characteristic of the impregnated-type cathode assembly of FIG. 7.

FIG. 9 shows the electron emission characteristic after aging was performed for 100 hours. This electron emission characteristic shows a relationship between an emission current and the cathode temperature wherein the emission current is expressed as a rate with respect to an emission current at a cathode temperature of 1100° C. b as 100%. In this figure, solid lines 31 and 32 respectively indicate the characteristics of a conventional impregnated-type cathode assembly and an impregnated-type cathode assembly according to the embodiment 1. As can be seen from this graph, the impregnated-type cathode assembly indicated by the solid line 32 according to the first embodiment is superior at a low temperature. Since the diffusion rate is high at a high temperature, any particular superiority of the impregnated-type cathode assembly of the present invention cannot be found at a high temperature. However, since the diffusion rate is low at a low temperature, it can be said that the impregnated-type cathode assembly of the present invention is apparently superior. Also, from this graph, it is apparent that the aging time can be shortened by using the impregnated-type cathode assembly according to the present invention.

EMBODIMENT 2

Figure 10:
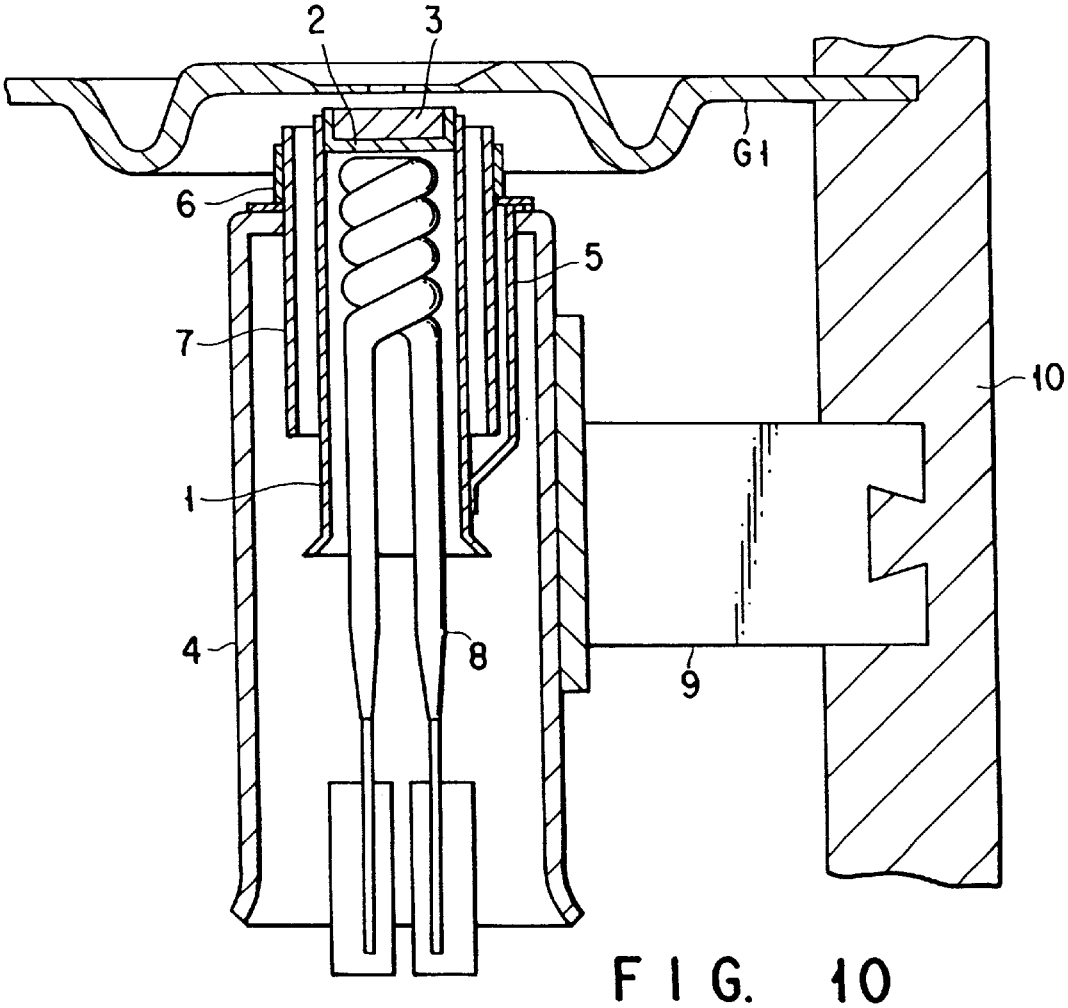
FIG. 10 is a schematic view showing a structure of a cathode assembly used in a second example.

FIG. 10 is a schematic view showing a second example of the impregnated-type cathode assembly used for another electron tube, according to the present invention. This cathode assembly is a cathode assembly for a cathode ray tube, and the cathode substrate thereof does not substantially have a curvature, unlike the cathode substrate for a klystron tube according to the embodiment 1.

As shown in the figure, the electron tube using the impregnated-type cathode assembly comprises, for example, a cathode sleeve 1, a cup-like fixing member 2 fixed to the inside of an end portion of the cathode sleeve 1 such that the member 2 forms a plane which is substantially the same as the opening edge of the end portion, a porous cathode substrate 3 fixed in the cup-like fixing member 2 and impregnated with an electron emission substance, a cylindrical holder 4 provided coaxially so as to surround the cathode sleeve 1, a plurality of strip-like straps 5 each having an end portion attached to the outer surface of the other end of the cathode sleeve 1 and having another end portion attached to an inner projecting portion formed at an end portion of the cylindrical holder 4 such that the cathode sleeve 1 is coaxially supported inside the cylindrical holder 4, and a shielding cylinder 7 which is attached to the inner projecting portion formed at the end portion of the cylindrical holder 4 by a supporting member 6 and which is provided between the cathode sleeve 1 and the plurality of straps 5. Heating is performed by a heater 8 inserted inside the cathode sleeve 1.

The material of the porous cathode substrate 3 is W. Pore portions of this base are impregnated with an electron emission substance consisting of a mixture whose mole ratio of BaO: CaO: $Al_2O_3$ is 4:1.

Note that this cathode assembly is fixed to an insulating supporting member 10, together with a plurality of electrodes provided sequentially at predetermined intervals on the cathode assembly by means of a strap 9 attached to the outer surface of the cylindrical holder 4. (Only an electrode G1 of the first grid is shown in the figure.)

The porous cathode substrate 3 has a structure similar to that shown in FIG. 8, and can be formed by a screen printing method, as will be described below.

At first, W particles, ethyl cellulose as a binder, a mixture of resin and an interface active agent, and a solvent are mixed to prepare a coating solution.

As a large diameter low porosity layer, a tungsten base is prepared which, for example, is made of W particles having a particle diameter of about 3 $\mu$m and has a porosity of about 17%. This base, for example, has a diameter of 1.1 mm and a thickness of 0.32 mm.

A tungsten thin film layer having a small particle diameter and a high porosity is formed on the base by screen-printing the coating solution, with use of a stainless mesh screen.

Thereafter, sintering is performed for one hour in an atmosphere of $H_2$ at a temperature of 2000° C., for the purpose of sintering the thin film layer and of adhering and sintering the thin film layer and the large particle diameter low porosity layer.

The obtained tungsten thin film layer having a small particle diameter and a high porosity is not apparently cracked, and has a sufficient strength, an average particle diameter of 1 $\mu$m, a porosity of about 30%, and a uniform thickness of about 10 $\mu$m. In addition, the cathode substrate thus obtained has the same two-layered structure as that shown in the model view of FIG. 8.

The method as described above was used to form a cathode substrate for a cathode ray tube in which the particle diameter and the porosity of the small particle high porosity region as well as the particle diameter and the porosity of the large particle diameter low porosity region are changed. The emission characteristic of this cathode substrate was evaluated and the cathode substrate was subjected to a forced life test. A cathode substrate thus prepared used tungsten as its material, and had a diameter of 1.1 mm and a thickness of 0.32 mm. An electron emission substance having a mole ratio of BaO: CaO: $Al_2O_3$=4:1:1 was impregnated. The small particle diameter high porosity region was formed to have a thickness of 10 $\mu$m, with use of a screen printing method. Further, a sputtered film of Ir was formed on this region.

The emission characteristic depending on a duty was evaluated, at an anode voltage 200 V with a heater voltage of 6.3 V, with use of a diode assembled by installing a heater, an anode, and the like onto the cathode substrate.

A forced life test was carried out under condition that the heater voltage was 8.5 V and the cathode current was 600 $\mu$A, while a cathode assembly assembled with use of this cathode substrate was mounted on a television picture tube having a screen diagonal size of 760 mm. As for measurement of the emission, a cathode current was measured when a heater voltage was 6.3 V, a voltage of 200 V was applied to the first grid, and a pulse of a duty 0.25% was applied.

The results are shown in the following tables 1 and 2.

TABLE 1

| Sample | Large particle diameter low porosity region: Particle diameter (μm) | Large particle diameter low porosity region: Porosity (%) | Small particle diameter high porosity region: Particle diameter (μm) | Small particle diameter high porosity region: Porosity (%) |
|---|---|---|---|---|
| 1 | 3 | 20 | 1 | 20 |
| 2 | 3 | 20 | 1 | 25 |
| 3 | 3 | 20 | 1 | 40 |
| 4 | 3 | 20 | 1 | 45 |
| 5 | 3 | 20 | 0.05 | 30 |
| 6 | 3 | 20 | 0.1 | 30 |
| 7 | 3 | 20 | 1 | 30 |
| 8 | 3 | 20 | 1.5 | 30 |
| 9 | 3 | 20 | 3 | 30 |
| 10 | 3 | 10 | 1 | 30 |
| 11 | 3 | 15 | 1 | 30 |
| 12 | 3 | 25 | 1 | 30 |
| 13 | 3 | 30 | 1 | 30 |
| 14 | 1 | 20 | 1 | 30 |
| 15 | 1.5 | 20 | 1 | 30 |
| 16 | 2 | 20 | 1 | 30 |
| 17 | 10 | 20 | 1 | 30 |
| 18 | 15 | 20 | 1 | 30 |

TABLE 2

| Sample | Emission at duty 0.1% (%) | Emission at duty 0.1% (%) | Forced life (%) | Others | Total evaluation |
|---|---|---|---|---|---|
| 1 | 88 | 88 | 120 | | x |
| 2 | 103 | 128 | 103 | | ○ |
| 3 | 103 | 125 | 102 | | ○ |
| 4 | 102 | 107 | 100 | Peeling of small particle diameter high porosity region | Δ<br>A |
| 5 | 60 | 70 | 120 | Difficult impregnation | Δ |
| 6 | 100 | 120 | 107 | | ○ |
| 7 | 105 | 166 | 101 | | ◎ |
| 8 | 102 | 120 | 101 | | ○ |
| 9 | 93 | 75 | 100 | | x |
| 10 | 101 | 132 | 69 | Difficult impregnation | Δ |
| 11 | 100 | 129 | 93 | | ○ |
| 12 | 102 | 150 | 90 | | ○ |
| 13 | 120 | 173 | 40 | | x |
| 14 | 82 | 121 | 66 | | x |
| 15 | 82 | 118 | 79 | | Δ |
| 16 | 93 | 105 | 100 | | ○ |
| 17 | 92 | 102 | 100 | | ○ |
| 18 | 68 | 88 | 91 | Difficult sintering of substrate | Δ |

In the tables, values of the emission (%) at a duty of 0.1% are test values expressed in percentage with respect to an emission amount as 100 (%) which is obtained when pulse operation of a duty 0.1% is performed with use of an electron tube using a cathode assembly which includes no small particle diameter high porosity region and which has a particle diameter of 3 μm and a porosity of 20%. In the same manner, values of the emission (%) at a duty of 4.0% are test values expressed in percentage with respect to an emission amount as 100 (%) which is obtained when pulse operation of a duty 4.0% is performed with use of an electron tube using a cathode assembly which includes no small particle diameter high porosity region and which has a particle diameter of 3 μm and a porosity of 20%. Further, the forced life (%) is expressed by the following calculation (2).

$$(I_{life}/I_0)/(I_{life}^{ref}/I_0^{ref})\times 100(\%) \quad (2)$$

Here, $I_0^{ref}$ is an emission value of an electron tube using a cathode substrate which has no small particle diameter high porosity region and which has a particle diameter of 3 μm and a porosity of 20% before a forced life test, and $I_{life}^{ref}$ is an emission value after the forced life test for 3000 hours. Meanwhile, the $I_0$ is an emission value of an electron tube using a cathode assembly having a structure shown in the table before a forced life test, and $I_{life}$ is an emission value after a forced life test for 3000 hours.

The forced life test was performed under condition that the cathode filament voltage was raised to 8.5 V from 6.3 V which is a cathode filament voltage of a conventional electron tube and the cathode temperature was kept increased.

As is apparent from the tables 1 and 2, when the porosity is 25 to 40%, the ion-impact resistance is improved. However, it is found that there is a tendency that the emission characteristic is deteriorated when the porosity is less than 25 and a sufficient strength of the small particle high porosity region cannot be obtained. When the particle diameter of the small particle diameter high porosity region is 0.1 μm or more and is less than 2 μm, the ion-impact resistance is improved. However, when the particle diameter is smaller than 0.1 μm, the number of pores opened in the cathode surface is considerably reduced so that it is difficult to perform impregnation. It is also found that a sufficient ion-impact resistance cannot be obtained when the particle diameter is larger than 2 μm.

In addition, when the porosity of the large particle diameter low porosity region is 15 to 25%, an excellent cathode characteristic is obtained. However, when the porosity is lower than 15%, the amount of an impregnated electron emission substance is apparently reduced so that the life-time is shortened. When the porosity exceeds 25%, there is a tendency that the evaporation speed of the electron emission substance is much increased so that the life-time is shortened. When the particle diameter of the large particle diameter low porosity is 2 μm or more and is smaller than 10 μm, an excellent cathode characteristic can be obtained. However, when the particle diameter is smaller than 2 μm, there is a tendency that closed pores appear, the impregnation amount is reduced, the life-time is shortened, and the emission characteristic is deteriorated. In addition, when the particle diameter of the large particle diameter low porosity region exceeds 10 μm, there apparently is a tendency that an enormous energy or time is required to obtain a predetermined porosity by means of sintering.

EMBODIMENT 3

This embodiment shows a third example of an impregnated-type cathode assembly according to the present invention.

At first, a porous W base was prepared as a large particle diameter low porosity layer similar to that of the embodiment 1. A plurality of processing grooves were formed to be 20 to 50 μm deep end at an equal pitch of 20 to 50 μm, in the surface of the porous W base, by means of mechanical processing such as grinding. Thereafter, W powder having an average particle diameter of 0.5 to 1 μm was filled in the processing grooves.

Figure 11:
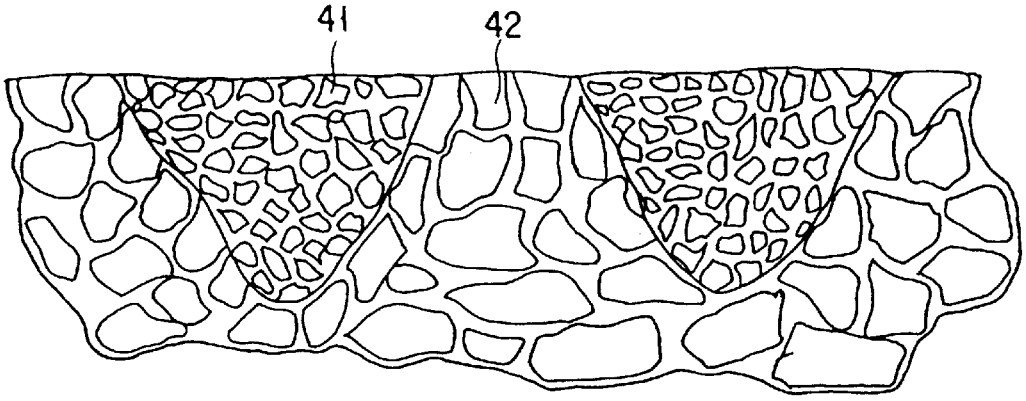
FIG. 11 is a model view showing a structure of a cathode assembly used in a third example.

Thereafter, a heat treatment was performed in the same manner as in the embodiment 1. A model view of a cathode substrate thus obtained is shown in FIG. 11. As shown in FIG. 11, this cathode substrate comprises a matrix consisting of a porous W base 42 as a large particle diameter low porosity region which is made of W particles of an average particle diameter of about 3 μm and which a porosity of about 17%, and W regions 41 which are scattered in the surface of the substrate and which have an average particle diameter of 0.5 to 1 μm and a porosity of 30%.

EMBODIMENT 4

This embodiment shows a fourth example of an impregnated-type cathode assembly according to the present invention. Here, a cathode substrate used for a cathode assembly of the same type as the embodiment 2 was formed by a spraying method.

At first, a porous W base which has a shape similar to that of the embodiment 2, a particle diameter of 3 μm, and a porosity of 20% was prepared as a large particle diameter low porosity layer.

In the next, a mixture of W particles and butyl acetate was prepared as a coating solution. This coating solution was vertically sprayed to the surface of the base, with use of an air-gun, at a spraying distance of 10 cm with an air pressure of 1.2 kg/cm$^2$ at a spray flow amount of 0.35 cc/sec for a spraying time of 5 seconds. A coated film thus obtained was dried thereafter, and was subjected to a heat treatment for ten minutes in a hydrogen atmosphere at a temperature of 1900° C. for the purpose of sintering the coated film and adhering the same to the substrate. A thin film of W thus formed and having a small particle diameter and a high porosity was not apparently cracked, and had a sufficient strength, a film thickness of 20 μm, an average particle diameter of 1 μm, and a porosity of 30%. In addition, the structure of the cathode assembly was the same as that shown as a model view of FIG. 8.

Figure 24:
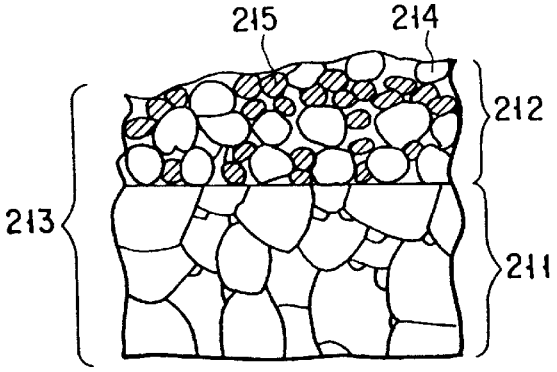
FIG. 24 is a view for explaining other steps of manufacturing a cathode assembly used in the present invention.

As shown in FIG. 8, an electron emission substance consisting of a mixture whose mole ratio of BaO: CaO: $Al_2O_3$ was applied onto the cathode substrate 23 having the two-layered structure, and was heated for ten minutes in a $H_2$ atmosphere at a temperature of 1700° C., so that the electron emission substance was melted and impregnated as shown in FIG. 24.

The cathode assembly thus prepared was adopted in the impregnated-type cathode assembly as shown in FIG. 10, and was equipped with an anode, thus preparing an electron tube of a diode structure. The electron emission characteristic of this electron tube was measured. As a result of this, the tube according to the present invention is improved in the electron emission characteristic in a high duty range in comparison with a conventional impregnated-type cathode.

EMBODIMENT 5

This embodiment shows a fifth example according to an impregnated-type cathode assembly of the present invention.

Here, the method of forming a thin film layer of W having a small particle diameter and a high porosity is as follows.

Except that W particles and a mixture solution of diethyl carbonate and nitrocellulose were prepared as a coating solution and that this coating solution was applied to the same porous W substrate as that of the embodiment 4 rotated at a speed of 1000 rpm by a spin-coating method, thin film layers of various thicknesses each having a small particle diameter and a high porosity were formed in the same manner as in the embodiment 4, and a cathode substrate was thus obtained. The thin film layer had an average particle diameter 1 μm and a porosity of 30%. The cathode substrate thus obtained had a two-layered structure as shown in FIG. 8.

An electron emission substance was melted and impregnated into the cathode substrate, in the same manner as in the embodiment 4.

In the next, a thin film layer of Ir was formed in the electron emission surface side of the cathode substrate impregnated with the electron emission substance, by a sputtering method. To form an alloy from an Ir thin film layer thus obtained and W of the cathode substrate, the cathode substrate on which an Ir film was formed was subjected to a heat treatment for 10 minutes in a hydrogen atmosphere at a temperature of 1290° C.

Figure 12:
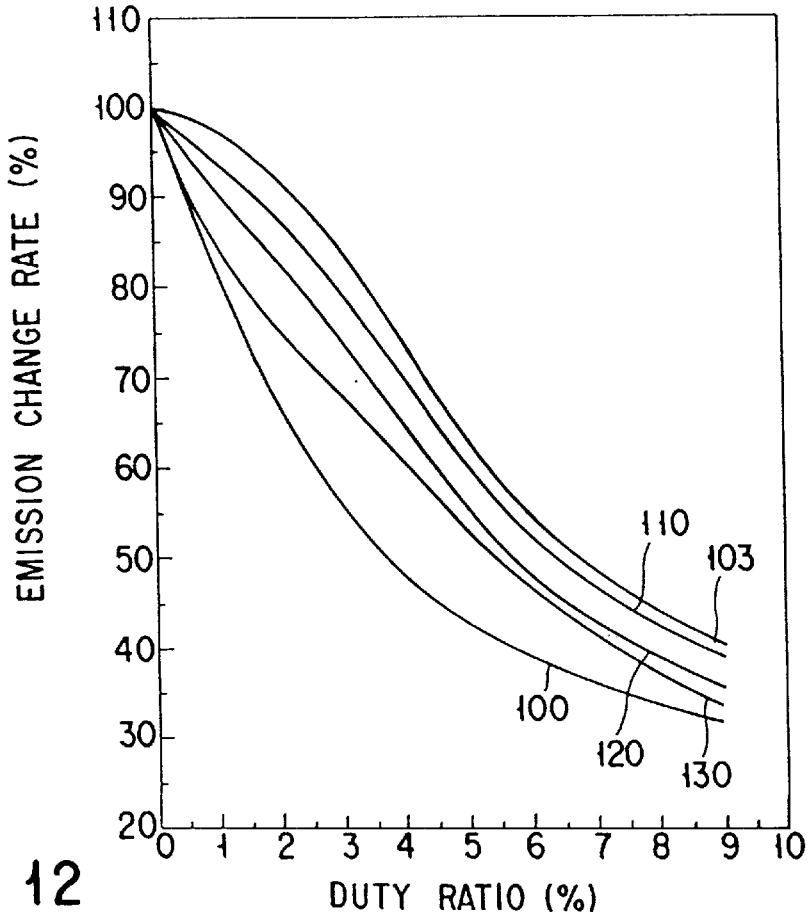
FIG. 12 is a graph showing the electron emission characteristic according to a fifth example.

The electron emission characteristic of an impregnated-type cathode thus obtained was evaluated in the same manner as in the embodiment 4. FIG. 12 shows the relationship between the duty of an applied pulse and the emission change rate, in this evaluation.

FIG. 12 shows the relationship between the duty and the emission change rate with respect to a case in which no small diameter high porosity layer was included in the two-layered structure and a case in which the layer thickness of the small diameter high porosity layer was changed. In this figure, a solid line 100 indicates a case of including no small particle diameter high porosity layer, a solid line 103 indicates a case of adopting a film thickness of 3 μm, a solid line 110 indicates a case of adopting a film thickness of 10 μm, a solid line 120 indicates a case of adopting a film thickness of 20 μm, and a solid line 130 indicates a case of adopting a film thickness of 30 μm. In this embodiment, the large particle diameter low porosity layer had a particle diameter of 3 μm and a porosity of 20%, and the small particle diameter high porosity layer had a particle diameter of 1 μm and a porosity of 30%. In addition, the emission change rate is expressed, with an emission obtained at a duty of 0.1% being regarded as 100%. The measurement conditions were a heater voltage of 6.3 V and an anode voltage of 200 V.

As is apparent from this figure, according to the present invention, the electron emission characteristic is improved in a high duty range, in comparison with a conventional cathode assembly, and an excellent electron emission characteristic in a high duty range can be obtained when the film thickness is within a range of 3 to 30 μm.

EMBODIMENT 6

This embodiment shows a sixth example of an impregnated-type cathode assembly according to the present invention.

At first, a porous W substrate having a particle diameter of 3 μm and a porosity of 20% was prepared as a large particle diameter low porosity layer. This cathode substrate is applicable to the cathode assembly for a cathode ray tube as shown in FIG. 10. W particles together with an organic solvent were prepared like paste on the electron emission surface layer of the cathode substrate, and was coated by screen printing such that a mixture layer had a thickness of 20 μm. Thereafter, coated paste was dried and subjected to a heat treatment for ten minutes in a hydrogen atmosphere at 1900° C., thereby to form a thin film layer of W having a small particle diameter and a high porosity. Note that the density of paste W, printing conditions, and the sintering time and temperature were arranged such that a sintered porous layer has an average particle diameter of 1 $\mu$m and a porosity of 30%.

A cathode substrate thus prepared had a two-layered structure as shown in FIG. 8.

An electron emission substance made of a mixture whose mole ratio BaO: CaO: $Al_2O_3$ was 4:1:1 was adopted, and this substance was melted and impregnated in pore portions of the cathode substrate, in a hydrogen atmosphere at a temperature of 1700° C. for 10 minutes.

Two layers of $ScH_2$ layers as Sc compound thin film layers and Re layers as high melting point metal thin film layers were alternately formed on the surface of the cathode substrate thus formed, by a sputtering method.

Figure 13:
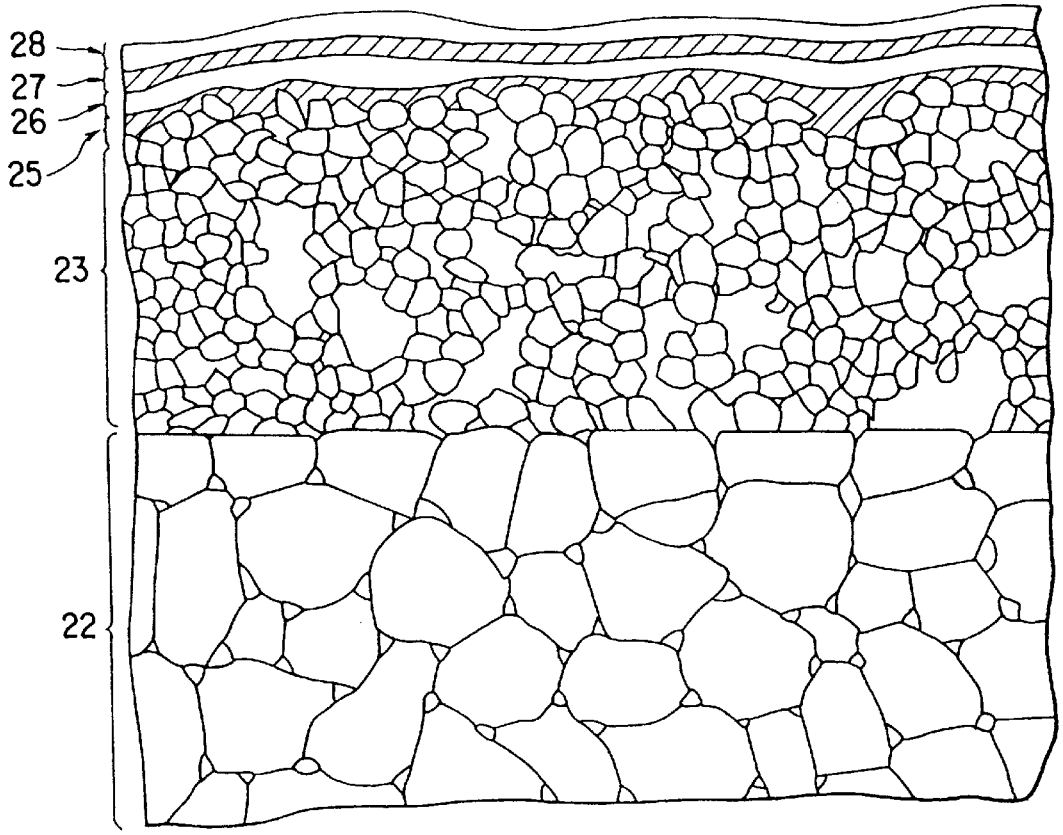
FIG. 13 is a model view showing a structure of a cathode assembly used in a sixth example.

The cathode substrate thus obtained had a structure in which a small particle high porosity layer 23 was layered on a large particle diameter low porosity layer 22, as shown in FIG. 13, and $ScH_2$ layers 25 and 27 and Re layers 26 and 28 as high melting point metal thin film layers are alternately layered on the layered assembly whose pores are impregnated with an electron emission substance. Each of the $ScH_2$ thin film layers and Re thin film layers had a thickness of 20 nm, and sputtering was alternately performed on every two of these layers. In particular, when sputtering $ScH_2$ thin film layers, a $H_2$ gas was introduced in addition to an Ar gas in order to prevent separation of $H_2$.

The cathode assembly thus prepared was adopted in an impregnated-type cathode assembly as shown in FIG. 10 and was equipped with an anode. An electron tube having a diode structure was thus prepared. The electron emission characteristic of this electron tube was evaluated as follows. At first, a pulse of 200 V was applied between the cathode and anode, at a heater voltage of 6.3 V. Here, while the duty of an applied pulse was changed from 0.1 to 9.0%, the emission current density was measured.

Figure 14:
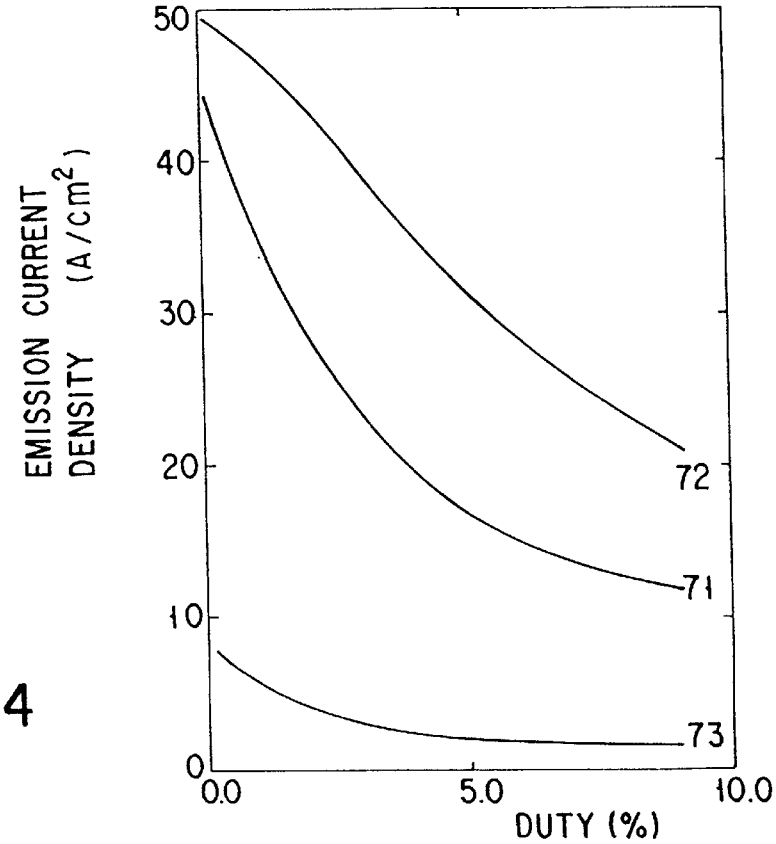
FIG. 14 is a graph showing the electron emission characteristic according to the sixth example.

FIG. 14 is a graph showing the emission characteristic of the impregnated-type cathode according to this embodiment, in form of a relationship between the duty and the emission current density of the impregnated-type cathode. In this figure, the curve 71 indicates a measurement result of a conventional (top-layer scandate) cathode substrated on, the curve 72 indicates a measurement result of a impregnated-type cathode according to the present invention, and the curve 73 indicates a measurement result of a conventional metal-coated impregnated-type cathode. The impregnated-type cathode according to the present invention has a more excellent emission current characteristic in both of low and high duty ranges than that of a conventional impregnated-type cathode.

When Ru or Hf was used as another example in place of Re contained in the high melting point metal thin film layer, or when Sc was used in place of $ScH_2$ contained in the scandium compound thin film layer, the same characteristic as described above was obtained.

EMBODIMENT 7

This embodiment shows a seventh example of the present invention.

FIGS. 15 to 21 are views for explaining steps of manufacturing a cathode substrate used in the present invention.

At first, tungsten particles having an average particle diameter of 3 $\mu$m were used to obtain a porous substance of a large particle diameter low porosity layer having a porosity of 20% in a normal method.

Thereafter, a film of paste containing tungsten was formed on a screen printing method, on the large particle diameter low porosity layer as obtained above. Subsequently, the film of paste was sintered for 30 minutes in a hydrogen atmosphere at a temperature of 1800° C., thereby obtaining a small particle diameter high porosity layer of a porous substance having an average particle diameter of 1 $\mu$m and a porosity of 30%. A cathode substrate was thus obtained.

Figure 15:
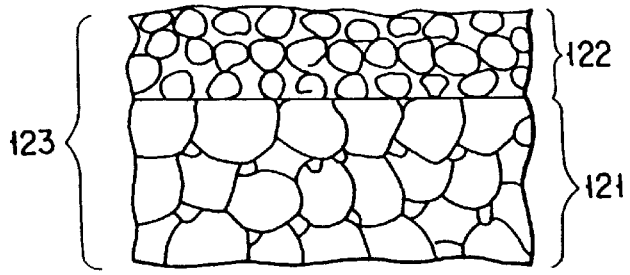
FIG. 15 is a view showing steps of manufacturing a cathode substrate used in the present invention.

FIG. 15 is a model view showing the cross-sectional structure of this cathode substrate. As shown in FIG. 15, an obtained cathode substrate 123 comprises a large particle diameter low porosity layer 121 and a small particle diameter high porosity layer formed on the layer 121.

In the next, copper particles were used to form a copper particle layer 131 on the large particle diameter low porosity layer 121. As a method of forming the copper particle layer 131, it is possible to use a method of performing screen printing with use of paste containing copper particles, and a method of directly covering the small particle high porosity layer 122 with copper particles. Here, the method of direct covering was used.

Figure 16:
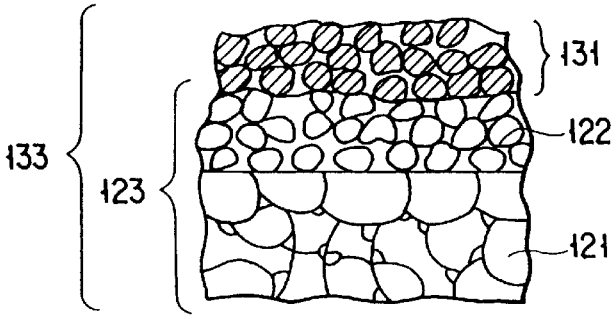
FIG. 16 is a view showing steps of manufacturing a cathode substrate used in the present invention.

FIG. 16 is a model view showing a cross-sectional structure of the cathode substrate thus obtained. As shown in FIG. 16, the cathode substrate 133 using copper particles had a copper particle layer 131 on the cathode substrate 123.

Thereafter, the cathode substrate 133 was set in a cup made of molybdenum, and heated to a temperature of 1080° C. in a hydrogen atmosphere, thereby melting the copper particles 131 and covering the surface of the small particle high porosity layer 122 with a copper covering layer. In this state, the heating temperature may be 1083° C. at most, and can be set to a temperature within a range in which copper covering can be sufficiently carried out.

Figure 17:
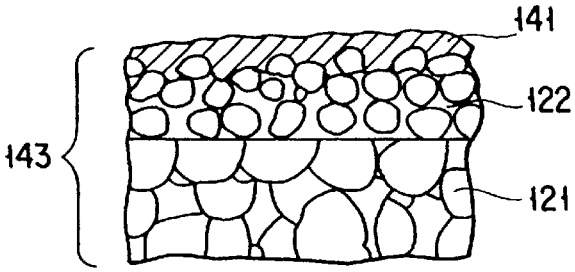
FIG. 17 is a view for explaining steps of manufacturing a cathode substrate used in the present invention.

FIG. 17 is a model view showing a cross-sectional structure of the cathode substrate 143 covered with a copper cover layer. As shown in FIG. 17, the cathode substrate 143 is covered with a copper cover layer 141.

Figure 18:
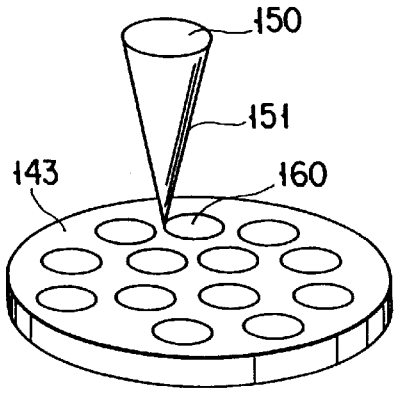
FIG. 18 is a view for explaining steps of manufacturing a cathode substrate used in the present invention.
Figure 19:
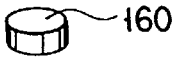
FIG. 19 is a view for explaining steps of manufacturing a cathode substrate used in the present invention.

FIG. 18 is a schematic view for explaining a step of cutting the cathode substrate. As shown in FIG. 18, an obtained cathode substrate 143 was thereafter cut by a laser beam 151 from a laser light source 150, and was cut into respective pieces of cathode substrates each having a predetermined size, as shown in FIG. 19.

Figure 20:
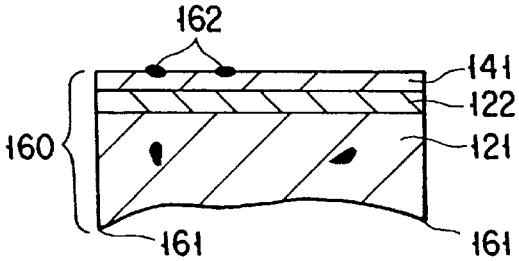
FIG. 20 is a view for explaining steps of manufacturing a cathode substrate used in the present invention.
Figure 21:
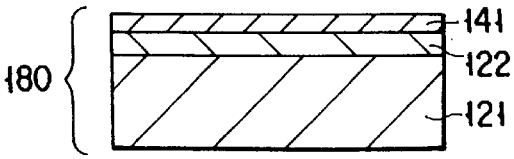
FIG. 21 is a view for explaining steps of manufacturing a cathode substrate used in the present invention.

FIG. 20 is a view showing the shape of a piece of the cathode substrate cut out as described above. FIG. 21 is a view schematically showing the state of the cathode substrate after tumbling processing. As shown in FIG. 20, a cut-out cathode substrate 160 had burrs 161, and contaminations 162 or the likes stick to the substrate 160 due to oxidization and evaporation.

Further, the cathode substrate 160 thus cut out was put in a closed container, together with a ball made of alumina and silica, and tumbling processing was performed with use of a barrel polisher. As shown in FIG. 21, burrs 161 and contaminations 162 were removed through this processing, so that a cathode substrate 180 comprising a large particle diameter low porosity layer 121, a small particle diameter high porosity layer 122, and a copper cover layer 141 was obtained.

Figure 22:
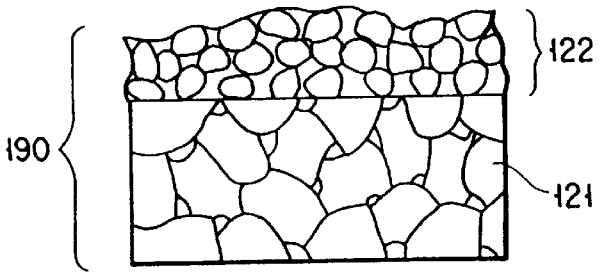
FIG. 22 is a model view showing a structure of a cathode substrate according to a seventh example.

The cathode substrate 180 thus obtained was dipped in a solution whose volume ratio of nitric acid: water is 1:1 for 12 hours, and was thereafter dried. Thereafter, the cathode substrate 180 was set in a cu made of molybdenum, and was heated at 1500° C. until flame of copper ceased. Copper was thus removed. FIG. 22 is a model view showing a state of a cathode substrate from which copper was removed. As shown in FIG. 22, deterioration in the shape of the surface due to cutting and tumbling was not found on the surface of the small particle diameter high porosity layer 122 after removal of copper, and thus, the surface condition was excellent. In addition, blockage of pore portions of the small particle diameter high porosity layer 122 was not found.

Figure 23:
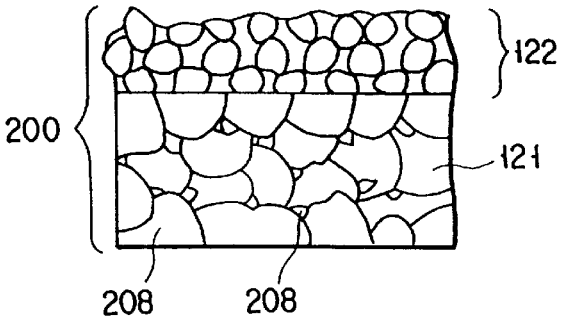
FIG. 23 is a model view showing a structure of a cathode substrate according to a seventh example.

Subsequently, an electron emission substance obtained by mixing barium oxide, calcium oxide, and aluminum oxide at a mole rate of 4:1:1 was applied onto the surface of the small particle high porosity layer 122, and was heated at a temperature of 1650° C. for three minutes in a hydrogen atmosphere, so that the substance was melted and impregnated into the cathode substrate 180. FIG. 23 is a model view showing the structure of an impregnated-type cathode thus obtained. As shown in FIG. 23, the applied electron emission substance 208 was impregnated into the pore portions of the large particle diameter low porosity layer 121 through the pore portions of the small particle diameter high porosity layer 122.

As explained above, according to the seventh example, cutting and tumbling steps are improved by using the method of the present invention, so that an excellent impregnated-type cathode can be obtained.

EMBODIMENT 8

The following explains an eighth example of the present invention.

Figure 25:
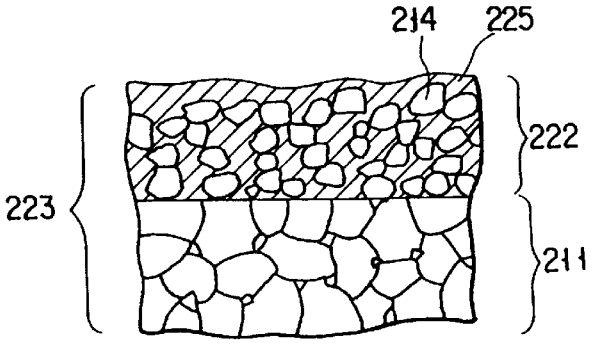
FIG. 25 is a view for explaining other steps of manufacturing a cathode assembly used in the present invention.

FIGS. 24 and 25 are views explaining manufacturing steps of a cathode assembly used in the present invention.

At first, a large particle diameter low porosity layer having an average particle diameter of 3 $\mu$m and a particle of 20% was obtained in the same manner as in the embodiment 7.

Thereafter, paste containing tungsten powder and copper particles was used to form a film on the large particle diameter low porosity layer as obtained above, by a screen printing method. Subsequently, the film of paste thus formed was sintered for 30 minutes at 1800° C. in a hydrogen atmosphere, and thus, a cathode substrate made of a porous body of a small particle diameter high porosity layer having an average particle diameter of 1 $\mu$m and a porosity of 30% was obtained.

FIG. 24 is a model view showing a cross-sectional structure of the cathode substrate. As shown in FIG. 24, a cathode substrate 213 thus obtained had a two-layered structure consisting of a large particle diameter low porosity layer 211 and a small particle diameter high porosity layer 212, wherein the small particle diameter high porosity layer 212 was a porous layer containing tungsten particles 214 and copper particles 215.

By heating the cathode substrate 213 in the same manner as in the embodiment 7, copper particles 131 were melted and the surface of the small particle diameter high porosity layer 212 was covered with copper, thus filling the pore portions with copper.

FIG. 25 is a model view showing a cross-sectional structure of a cathode substrate in which pore portions were filled with copper. As shown in FIG. 25, the small particle diameter high porosity layer 222 of the cathode substrate 223 had a structure in which pore portions between tungsten particles 214 were filled with melted copper 225.

The cathode substrate 223 thus obtained was cut in the same manner as in the embodiment 7, and tumbling processing was carried out to remove copper components. Deterioration in the shape of the surface due to cutting and tumbling was not found in the surface of the small particle diameter high porosity layer after copper was removed, and the surface condition was excellent. In addition, blockage of the pore portions of the small particle diameter high porosity layer was not found.

Subsequently, an electron emission substance was applied and melted onto the surface of the small particle diameter high porosity layer, in the same manner as in the embodiment 7, and thus, the substance can be sufficiently melted and impregnated into the cathode substrate.

According to the eighth embodiment, cutting and tumbling steps are improved by using the method of the present invention, so that an excellent impregnated-type cathode can be obtained without making damages on the electron emission surface.

The impregnated-type cathode substrate or the impregnated-type cathode assembly using the substrate was used for electron tubes, such as a cathode ray tube, a klystron tube, a traveling-wave tube, and a gyrotron, e.g., the cathode ray tube shown in FIG. 3, the klystron tube shown in FIG. 4, the traveling-wave tube shown in FIG. 5, and the gyrotron shown in FIG. 6. Then, various electron tubes were obtained which attains a high performance ability and a long life time and which have a sufficient ion-impact resistance and an excellent electron emission characteristic, under condition of a high voltage and a high frequency. Note that the impregnated-type cathode substrate of the present invention is not limited to the embodiments as described above, but may be used for other various electron tubes.

What is claimed is:

1. An electron tube comprising an electron gun assembly having an impregnated-type cathode assembly, the cathode assembly including an impregnated-type cathode substrate, wherein said impregnated-type cathode substrate comprises:

a large particle diameter low porosity region and a small particle diameter high porosity region, the small particle diameter high porosity region (i) being provided in an electron emission surface side of the large particle diameter low porosity region and (ii) having an average particle diameter smaller than an average particle diameter of the large particle diameter low porosity region and a porosity higher than a porosity of the large particle diameter low porosity region, said impregnated-type cathode substrate being impregnated with an electron emission substance.

2. An electron tube according to claim 1, wherein the impregnated-type cathode assembly further comprises:

a cylindrical cathode sleeve;

an impregnated-type cathode substrate fixing member fixed to an inner surface of an end portion of the cathode sleeve;

a cylindrical holder coaxially provided outside the cathode sleeve so as to surround the cathode sleeve;

a plurality of straps each having an end portion fixed to the outside of the cathode sleeve and another end portion fixed to the inside of the cylindrical holder, the plurality of straps supporting the sleeve inside the holder; and a heater provided inside the cathode sleeve.

3. An electron tube according to claim 1, wherein the impregnated-type cathode assembly further comprises:

a support cylinder for supporting the impregnated-type cathode substrate; and a heater included in the support cylinder and embedded in an insulating material.

4. An electron tube according to claim 1, wherein the electron gun assembly further comprises:

a plurality of grid electrodes coaxially arranged in the electron emission surface side of the impregnated-type cathode assembly;

a convergence electrode (i) coaxially arranged in the electron emission surface side and (ii) connected to one of the plurality of grid electrodes in a rear stage of the assembly; and a resistor provided as a voltage divider, the resistor being arranged in the assembly and connected to (i) selected other ones of the plurality of grid electrodes and (ii) the convergence electrode.

5. An electron tube according to claim 1, wherein the electron gun assembly further comprises:

a cathode portion incorporating the impregnated-type cathode assembly; and an anode portion coaxially provided on the electron emission surface of the impregnated-type cathode assembly.

6. An electron tube used according to claim 1, further comprising:

a vacuum outer envelope having a face portion positioned in the vicinity of one end of the electron tube, the electron gun assembly being positioned in the vicinity of the other end of the electron tube;

a fluorescent layer provided on an inner surface of the face portion, the inner surface being positioned between the face portion and the gun assembly; and a shadow mask provided between the fluorescent layer and the electron gun assembly.

7. An electron tube according to claim 1, further comprising:

a high frequency acting portion and a collector portion, the high frequency acting portion having a plurality of resonance cavities coaxially arranged in the electron emission surface side of the electron gun assembly, wherein the high frequency acting portion and the collector portion are connected by a drift tube; and a magnetic field generating device provided in the vicinity of the high frequency acting portion.

8. An electron tube according to claim 1, further comprising:

a slow-wave circuit (i) coaxially provided in the electron emission surface side of the impregnated-type cathode assembly and (ii) for amplifying a signal; and a collector portion for tapering an electron beam.

9. An electron tube according to claim 1, further comprising:

a tapered electron beam compressing portion provided in the electron emission surface side of the impregnated-type cathode assembly, the beam compressing portion having a gradually decreasing diameter;

a cavity resonance portion arranged to be continuous with the tapered beam compressing portion;

a tapered electromagnetic waveguide guiding portion provided to be continuous with the cavity resonance portion, the waveguide guiding portion having a gradually increasing diameter;

a collector portion for capturing an electron beam; and a magnetic field generator device provided at an outer circumferential portion of the cavity resonance portion.

10. An electron gun assembly using an impregnated type cathode assembly including an impregnated type cathode substrate, wherein said impregnated type cathode substrate comprises:

a large particle diameter low porosity region and a small particle diameter high porosity region, the small particle diameter high porosity region (i) being provided in an electron emission surface side of the large particle diameter low porosity region and (ii) having an average particle diameter smaller than an average particle diameter of the large particle diameter low porosity region and a porosity higher than a porosity of the large particle diameter low porosity region, said impregnated-type cathode substrate being impregnated with an electron emission substance.

* * * * *